US009591918B2

(12) United States Patent
Nye et al.

(10) Patent No.: US 9,591,918 B2
(45) **Date of Patent: *Mar. 14, 2017**

(54) LOCKING MEMBER FOR A TABLE LEG

(71) Applicant: LIFETIME PRODUCTS, INC., Clearfield, UT (US)

(72) Inventors: S. Curtis Nye, Clinton, UT (US); Mitch Johnson, South Weber, UT (US); Wendell Peery, Kaysville, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/872,005

(22) Filed: Sep. 30, 2015

(65) Prior Publication Data

US 2016/0022028 A1 Jan. 28, 2016

Related U.S. Application Data

(63) Continuation of application No. 13/741,285, filed on Jan. 14, 2013, which is a continuation-in-part of (Continued)

(51) Int. Cl.
*A47B 7/00* (2006.01)
*A47B 3/091* (2006.01)
(Continued)

(52) U.S. Cl.
CPC ..... *A47B 3/0915* (2013.01); *A47B 3/00* (2013.01); *A47B 3/08* (2013.01); *A47B 3/0809* (2013.01);
(Continued)

(58) Field of Classification Search
CPC ..... A47B 3/0912
(Continued)

(56) References Cited

U.S. PATENT DOCUMENTS 2,459,529 A 1/1949 Walter et al.
2,540,849 A * 2/1951 Walker ..... A47B 3/0915 108/125
(Continued)

OTHER PUBLICATIONS

U.S. Appl. No. 29/390,471, filed Apr. 25, 2011, Winter, et al.
(Continued)

*Primary Examiner* — Matthew Ing
(74) *Attorney, Agent, or Firm* — Maschoff Brennan

(57) ABSTRACT

A table may be sized and configured to nest with an adjacent table to reduce a height of a plurality of stacked tables in a nested configuration. The table may include a table top with a round or circular configuration and the table top may have a receiving portion, a downwardly extending lip, a contact surface and an engaging portion. The contact surface may have a ring-shaped configuration and be sized and configured to contact an upper surface of a table top of an adjacent table when the table is nested with the adjacent table. The engaging portion may also have a ring-shaped configuration and may be sized and configured to be disposed in a receiving portion of a table top of the adjacent table when the table is nested with the adjacent table.

20 Claims, 12 Drawing Sheets

Related U.S. Application Data application No. 29/412,781, filed on Feb. 7, 2012, now Pat. No. Des. 683,985, said application No. 14/872,005 is a continuation-in-part of application No. 29/412,786, filed on Feb. 7, 2012, now abandoned.

(60) Provisional application No. 61/596,153, filed on Feb. 7, 2012, provisional application No. 61/586,710, filed on Jan. 13, 2012.

(51) Int. Cl.

| | |
|---|---|
| ***A47B 3/08*** | (2006.01) |
| ***A47B 3/00*** | (2006.01) |
| ***A47B 7/02*** | (2006.01) |
| ***A47B 87/02*** | (2006.01) |

(52) U.S. Cl.
CPC ..... *A47B 3/0815* (2013.01); *A47B 7/02* (2013.01); *A47B 87/02* (2013.01)

(58) Field of Classification Search
USPC .... 108/53.3, 125, 126, 132; 312/319.1, 333, 312/334.44, 334.46
See application file for complete search history.

(56) References Cited

U.S. PATENT DOCUMENTS

| | | | | |
|---|---|---|---|---|
| 3,604,372 | A * | 9/1971 | Hewett | A47B 3/0916 108/129 |
| 3,717,375 | A * | 2/1973 | Slobodan | A47B 83/02 297/154 |
| 3,917,108 | A | 11/1975 | Thurman | |
| 4,557,200 | A * | 12/1985 | Geschwender | A47B 23/001 108/132 |
| D357,144 | S | 4/1995 | Hand | |
| 5,505,142 | A | 4/1996 | Fink | |
| 5,678,491 | A | 10/1997 | Price et al. | |
| D414,626 | S | 10/1999 | Collins et al. | |
| D420,527 | S | 2/2000 | Pinch et al. | |
| D424,838 | S | 5/2000 | Newhouse | |
| D424,840 | S | 5/2000 | Newhouse | |
| 6,371,034 | B1 | 4/2002 | Simpson et al. | |
| D468,135 | S | 1/2003 | Ashby et al. | |
| 6,508,184 | B1 * | 1/2003 | Winter | A47B 13/021 108/125 |
| D471,384 | S | 3/2003 | Sabo et al. | |
| D476,823 | S | 7/2003 | Jackson | |
| D477,475 | S | 7/2003 | Moore | |
| 6,651,568 | B1 * | 11/2003 | Buono | A47B 3/0915 108/127 |
| D487,205 | S | 3/2004 | Mower et al. | |
| 6,718,887 | B1 | 4/2004 | Cook, Sr. | |
| D489,557 | S | 5/2004 | Strong et al. | |
| D499,283 | S | 12/2004 | Winter et al. | |
| D511,637 | S | 11/2005 | Strong | |
| D511,913 | S | 11/2005 | Kearl et al. | |
| 7,073,450 | B2 | 7/2006 | Tsai | |
| 7,299,753 | B2 | 11/2007 | Strong | |
| D575,083 | S | 8/2008 | Lin et al. | |
| 7,703,402 | B2 * | 4/2010 | Larcom | A47B 3/0815 108/132 |
| 7,707,947 | B2 | 5/2010 | Winter et al. | |
| 7,707,949 | B2 | 5/2010 | Larcom et al. | |
| 7,735,431 | B2 | 6/2010 | Neunzert | |
| D619,831 | S | 7/2010 | Branch | |
| 7,757,617 | B2 | 7/2010 | Larcom et al. | |
| D640,487 | S | 6/2011 | Bennett | |
| 8,042,475 | B2 | 10/2011 | Larcom et al. | |
| D683,985 | S | 6/2013 | Nye et al. | |
| 2003/0221595 | A1 | 12/2003 | Reinsch et al. | |
| 2007/0199483 | A1 | 8/2007 | Peery et al. | |
| 2008/0264307 | A1 | 10/2008 | VanNimwegen et al. | |
| 2009/0293778 | A1 | 12/2009 | Branch | |
| 2011/0219992 | A1 | 9/2011 | Galloro | |
| 2013/0180438 | A1 * | 7/2013 | Nye | A47B 3/08 108/91 |

OTHER PUBLICATIONS

U.S. Appl. No. 29/391,721, filed May 12, 2011, Bennett.
U.S. Appl. No. 29/400,986, filed Sep. 5, 2011, Clegg, et al.
U.S. Appl. No. 29/403,327, filed Oct. 4, 2011, Winter, et al.
U.S. Appl. No. 29/403,330, filed Oct. 4, 2011, Clegg, et al.
U.S. Appl. No. 29/403,313, filed Oct. 4, 2011, Clegg, et al.
U.S. Appl. No. 29/403,332, filed Oct. 4, 2011, Winter, et al.
U.S. Appl. No. 61/586,710, filed Jan. 13, 2012, Nye et al.
U.S. Appl. No. 29/411,483, filed Jan. 20, 2012, Winter, et al.
U.S. Appl. No. 29/412,786, filed Feb. 7, 2012, Nye et al.
U.S. Appl. No. 61/596,153, filed Feb. 7, 2012, Nye et al.
U.S. Appl. No. 29/412,786, filed Feb. 7, 2012, Nye, et al.
U.S. Appl. No. 29/415,705, filed Mar. 13, 2012, Johnson, et al.
U.S. Appl. No. 29/417,529, filed Apr. 4, 2012, Winter, et al.
U.S. Appl. No. 13/471,285, filed Jan. 14, 2013, Nye et al.
Notice of Allowance from U.S. Appl. No. 13/471,285 mailed Aug. 31, 2016.
Office Action from U.S. Appl. No. 13/471,285 mailed Feb. 5, 2016.
Office Action from U.S. Appl. No. 13/471,285 mailed Mar. 30, 2015.
Office Action from U.S. Appl. No. 13/471,285 mailed Sep. 10, 2014.
Office Action from U.S. Appl. No. 13/471,285 mailed Feb. 26, 2014.
Office Action from U.S. Appl. No. 13/471,285 mailed Jul. 24, 2013.
Office Action from U.S. Appl. No. 29/419,781 dated Oct. 18, 2012.
Office Action from U.S. Appl. No. 29/419,786 dated Oct. 12, 2012.
Office Action from U.S. Appl. No. 29/443,363 dated Apr. 24, 2013.

* cited by examiner

LOCKING MEMBER FOR A TABLE LEG

CROSS-REFERENCE TO RELATED APPLICATIONS

The present application is a continuation of application U.S. patent application Ser. No. 13/741,285, filed on Jan. 14, 2013, entitled TABLE. U.S. patent application Ser. No. 13/741,285 claims priority to and the benefit of U.S. Provisional Patent Application Ser. No. 61/586,710, entitled TABLE, filed Jan. 13, 2012; U.S. Provisional Patent Application Ser. No. 61/596,153, entitled TABLE, filed Feb. 7, 2012; U.S. Design patent application Ser. No. 29/412,781, entitled TABLE TOP, filed Feb. 7, 2012, now U.S. Pat. No. D683,985; and U.S. Design patent application Ser. No. 29/412,786, entitled SUPPORT FOR A TABLE, filed Feb. 7, 2012, now abandoned. Each of these patents and applications is hereby incorporated by reference in its entirety.

BACKGROUND OF THE INVENTION

Field of the Invention

The present invention generally relates to furniture and, in particular, to tables.

Description of Related Art

Conventional tables are used for a variety of purposes and come in a wide array of designs. Conventional tables often include table tops constructed from materials such as wood, particle board or metal. Table tops constructed from wood, particle board or metal, however, are often relatively heavy and this may make the table awkward or difficult to move. Table tops constructed from wood or metal are also relatively expensive and these types of table tops must generally be treated or finished before use. For example, table tops constructed from wood must generally be sanded and painted, and metal table tops must be formed into the desired shape and painted. In addition, table tops constructed from wood or metal are relatively heavy and that may increase the cost of shipping, transportation and/or storage of the tables.

In order to decrease the weight of conventional tables, table tops may be constructed from relatively light-weight materials such as plastic. Disadvantageously, table tops constructed from light-weight materials may require reinforcing members or additional structural components such as braces, brackets, support members and the like to strengthen the table top. While these additional parts may increase the strength of the table top, the additional parts may also increase the weight of the table. These additional parts may also increase manufacturing costs and require additional time to assemble the table. For example, more fasteners may be required to assemble and connect these additional parts to the table, which may require extra time and labor during the manufacturing process. The additional parts and fasteners may also increase the cost of the table and make the table more difficult to manufacture. Furthermore, these additional parts may have sharp edges that can injure a user's legs or arms.

Conventional tables often include legs that are sized and configured to support the table top above a surface, such as the floor or ground, and a frame that is connected to the table top. The frame may include a pair of side rails that are connected to the sides of the table top using fasteners. A number of fasteners may be required to securely connect the frame to the table top. Multiple fasteners may be required so that forces applied to the table top are transmitted to the frame.

When a large load or force is applied to some known tables, the frame may undesirably bend, deform and/or detach from the table top. In addition, the fasteners used to connect the frame to the table top may detach or separate from the table top. The fasteners may even damage and tear through the table top if the load or force exceeds a certain amount. Further, the frames and fasteners may allow the table to break or collapse in some circumstances.

BRIEF SUMMARY OF THE INVENTION

A need therefore exists for a table top or table that eliminates or diminishes the above-described disadvantages and problems.

One aspect is a table that may include a table top and one or more legs that are sized and configured to support the table top above a support surface such as the floor or ground. The table may also include a frame and the legs may be connected to the frame. The legs may be movable relative to the table top between a collapsed or storage position and an extended or use position. In particular, the legs may be pivoted between a collapsed position in which the legs are disposed at least proximate a lower surface of the table top and an extended position in which the legs extend outwardly from the table top. If desired, the legs may at least partially contact or abut the lower surface of the table top when the legs are in the collapsed position. In addition, the table top may include one or more recesses that are sized and configured to receive at least a portion of the legs when the legs are in the collapsed position. Advantageously, this may decrease the amount of space required to store and/or transport the table.

Another aspect is a table that may be relatively lightweight, which may allow the table to be more easily transported and moved. For example, the table may include a lightweight table top and that may help reduce the overall weight of the table. The table may also be constructed from a limited number of parts or components, which may allow the weight of the table to be reduced.

Still another aspect is a table that may include a table top constructed from plastic. For example, the table top may be constructed from blow-molded plastic. The blow-molded plastic table top may provide a relatively rigid, high-strength structure that is capable of withstanding repeated use and wear. In addition, the blow-molded plastic table top may be easily manufactured, readily molded into the desired size and shape, and relatively lightweight. The blow-molded plastic table top may also be quickly and efficiently manufactured. For instance, the blow-molded plastic table top may include two opposing walls that are spaced apart by distance, which may be generally constant, and that may help increase the strength and/or rigidity of the table top. The blow-molded plastic table top may also include one or more depressions or tack-offs, and the depressions may be designed to increase the strength of the table top and/or interconnect the spaced apart walls. Additionally, the blow-molded plastic table top may be generally weather resistant and temperature insensitive. Further, the blow-molded plastic table top may not corrode, rust or otherwise deteriorate over an extended period of time, which may help create a long lasting table.

Yet another aspect is a table that may include a frame with a first portion disposed towards one side of the table top and a second portion disposed towards another side of the table top. In particular, the frame may include a first side rail disposed proximate a first side of the table top and a second side rail disposed proximate a second side of the table top.

One or more portions of the side rails of the frame may be spaced closer to the sides or edges of the table top than other portions of the side rails. For instance, if the table top has round or has a circular configuration, then the ends of the side rails may be disposed at least proximate a side, edge or lip of the table top and the center portion of the side rails may be spaced apart from the outer edge of the table top by a greater distance. If desired, one or more ends of the side rails may be at least partially disposed in the lip of the table top. The frame may also have other suitable shapes and configurations such as curved, circular and the like.

A further aspect is a table that may include one or more openings in the lip and the openings may help create at least a portion of a handle. The openings may also allow a portion of the frame to be visible or exposed. For example, when looking at the side of the table top, the openings may allow a portion of the frame to be seen. In greater detail, the openings may allow a portion of a side rail of the frame to be at least partially exposed. This portion of the side rail may be spaced apart from the edge of the table top. If the frame is inwardly disposed from the outer perimeter of the table top, that may help protect the frame from damage. Advantageously, the exposed frame may indicate to a user or purchaser that the table has increased strength and/or rigidity. The exposed frame may also create a table with improved aesthetics and style. For example, the exposed frame may provide a color contrast with the table top. That is, the table top may be one color and the frame may have a different color in order to create a table with a stylized appearance.

A still further aspect is a table that may include a frame and legs that are constructed from a relatively strong and sturdy material such as metal. In particular, steel may be used to construct the frame and/or legs. It will be appreciated the frame and/or legs may be constructed from other suitable materials and may have a variety of shapes, sizes, configurations and/or arrangements depending, for example, upon the type and/or intended use of the table. For example, the frame and/or legs may be constructed from high-strength, low-alloy (HSLA) steel rather than carbon steel. Importantly, HSLA steel may be twenty to thirty percent (20 to 30%) lighter than carbon steel with the same strength. Therefore, the table constructed with HSLA steel may be lighter weight and have the same strength as a conventional table with a carbon steel frame.

Yet another further aspect is a table that may facilitate stacking of a plurality of tables. Advantageously, the stacked tables may be disposed in an aligned configuration. For example, a table may be easily aligned with an adjacent table to allow the tables to be lined up without difficulty, which may facilitate shipping, storage and/or display of multiple tables. In particular, lower and/or upper portions of the table may be sized and configured to facilitate stacking of the tables.

Another aspect is a table that may be nested with one or more adjacent tables. Advantageously, the nested tables may reduce the height of the stacked tables. For example, known tables may have a table top with a thickness of 2.125 inches and thirty (30) of these known tables could be stacked with a minimum height of 63.75 inches. The nested tables may still have a table top with a thickness of approximately 2.125 inches but the nested table may only have an effective height of about 1.75 inches because a lower portion of the table may be disposed in a receiving portion of an adjacent, stacked table. That is, the nested table may still have a table top with a thickness of about 2.125 inches, but the thirty nested tables may have a height of about 52.75 inches because the effective height of a table in a nested configuration may be only about 1.75 inches. Consequently, each nested table may have a reduction in height of about 0.375 inches in comparison to previously known tables. Significantly, this may allow more tables to be disposed in a nested configuration, which may increase the number of tables in a shipping container, on a truck or on a shelf. This may also allow a smaller area to be used for the same number of tables. In addition, the nested tables may help protect the tables from damage.

Still another aspect is a table that may include a table top with receiving portion such as a groove, channel or recessed portion, which is sized and configured to receive a portion of an adjacent table to facilitate nesting of the tables. For example, the receiving portion may be disposed about an outer perimeter of the table top. In particular, the receiving portion may be formed in the upper surface and outer perimeter of the table top. The receiving portion may include a lower surface that is generally parallel to the upper surface of the table top and a side wall that is generally perpendicular to the upper surface of the table top. The edges of the receiving portion may be rounded or curved if desired. When two tables are nested, a lower portion of one table top may be disposed in the receiving portion of the adjacent table. In greater detail, a lower edge of the table top of one table may be disposed in the receiving portion of the other table.

Advantageously the height of a stack of tables may be decreased by more than ten percent (10%) in the nested configuration. For example, the height of a single table may be about 2.125 inches measured from the lowermost portion to the uppermost portion when the legs are in the collapsed position. When the table is nested with other tables, however, the effective height of the nested table may be about 1.75 inches because a portion of the nested tables may overlap and/or nest. Preferably, the nested tables include overlapping portions that are about 0.25 inches to about 0.375 inches in size, but the overlapping portions could be smaller such as about 0.125 inches or larger such as about 0.4 or 0.5 inches. This allows the height of a table in the nested configuration to be decreased by about 12.5% than in the non-nested configuration. Significantly, tables may be more efficiently stored, transported and displayed because less space may be required. For example, a standard pallet or typical shipping configuration may include twenty-one conventional tables, but tables with the disclosed nesting features may allow between about twenty-seven and about twenty-nine tables to be disposed on a standard pallet or in a typical shipping configuration. If twenty-seven tables are disposed on a pallet or in a standard shipping configuration rather than twenty-one tables, then twenty-eight percent (28%) more tables can be stored, transported or displayed. Similarly, if twenty-nine tables rather than twenty-one tables are disposed on a pallet or in a standard shipping configuration, then a thirty-eight percent (38%) increase in the number of tables may be realized. The disclosed nesting features may result in significant savings and cost advantages.

Yet another aspect is a table that may be sized and configured to nest with an adjacent, stacked table and the table may include one or more contact areas that are sized and configured to contact the upper surface of the adjacent table top. For example, the lip may include a generally planar lower surface that is disposed generally parallel to an upper surface of the table top and is sized and configured to contact the upper surface of an adjacent, nested table. In addition, the lower surface of the lip may include an engaging portion, such as a flange or edge, which is sized and configured to be disposed in a receiving portion of the adjacent, nested table. Advantageously, the contact areas may facilitate nesting of the tables without marring or otherwise damaging the tables. In greater detail, the contact areas may directly support weight and/or forces applied to the tables in the nested configuration, which may help prevent damage to the tables. For instance, when the tables are nested in a horizontal configuration, the contact areas may allow the stacked tables to support a significant amount of weight without damage to the tables. For example, ten, twenty, thirty or more tables may be disposed in a nested configuration without damaging any of the tables. In addition, if an engaging portion is disposed in a receiving portion of an adjacent table, that may facilitate storing and/or shipping of the tables because the tables may be aligned and the weight properly and/or evenly distributed. In addition, this may decrease the height of the nested tables, which may be very significant especially when manufacturing, shipping, storing and/or displaying multiple tables.

A further aspect is a table that may include a handhold, handle, grip or opening in the table top. For example, the table may include a recess or opening in the lip to form a handle. Preferably, the handle is sized and configured to facilitate moving and transporting the table. In addition, the handle may be sized and configured to allow the stacked and nested tables to be quickly and easily separated by the user by allowing, for instance, a user to insert one or more fingers into the opening or gap between the table tops.

A still further aspect is a table that may include a table top with one or more portions formed from compression molded plastic. For example, at least a portion of the lip, such as the engaging portion, may be compression molded during the blow-molding process. The compression molded portion may be disposed about all or a portion of the perimeter of the table top and the compression molded portion may be formed by the outer wall being folded onto itself such that the compression molded portion has a thickness approximately equal to twice the outer wall thickness. Advantageously, the compression molded portion may help create stronger, more rigid and/or more impact resistant structures, which may increase the durability and usefulness of the table. Significantly, the compression molded portion may be relatively thin because there is little or no gap or space between the walls of the blow molded plastic structure. The compression molded portion may be generally aligned with the perimeter or outer edge of the table top. The compression molded portion may also be sized and configured to fit within the receiving portion of an adjacent nested table. The compression molded portion may have a height of about 0.125 inch to about 0.25 inch and, or about 0.25 inch to about 0.5 inch depending, for example, upon the shape, size, configuration and/or arrangement of the table.

Yet another further aspect is a table that may include a table top with a plurality of depressions. The depressions may be closely spaced and cover at least a majority of a lower surface of the table top. The depressions may be disposed in a generally uniform pattern in which the depressions have generally the same size, shape, configuration and arrangement. In addition, the depressions are preferably spaced apart from adjacent depressions by a generally constant distance. Advantageously, this may help create a table top with generally uniform characteristics.

Still yet another further aspect is a table that may include a brace connected to one or more of the legs. For example, the brace may include a first end connected to the table top and/or frame and a second end connected to a leg. The brace is preferably sized and configured to help support and maintain the leg in an extended position relative to the table top. The brace may be a slotted brace and the brace may be biased into one or more desired positions. For example, the brace may be biased to lock the legs in a generally fixed position, which may secure the leg in the extended position. The brace may include a pin connected to a leg and disposed within a slot in the brace. The brace may also include a biasing member that is used to bias the brace into a desired position. The biasing member may be a spring, which may be constructed from metal or other deformable and/or resilient materials.

Advantageously the table may include components that can be quickly and easily manufactured. For example, the legs and/or frame may be relatively straightforward to manufacture. In addition, the legs and/or frame may be quickly and easily attached to the table top, which may reduce manufacturing costs. The table may also be constructed from only a few parts and a limited number of fasteners, which may allow the table to be quickly and easily assembled by the manufacturer, retailer and/or consumer. Additionally, the table may include a combination of features and aspects, such as one or more of those discussed above. One of ordinary skill in the art will appreciated the disclosed table and its various parts and components may have various shapes, sizes, configurations and arrangements depending, for example, upon the intended use of the table.

Another aspect is a table top that may include strengthening members which are integrally formed as part of a unitary, one-piece construction. For example, the strengthening members may comprise outwardly extending portions, such as ribs or protrusions, that extend outwardly from the lower surface of the table top and/or inwardly extending portions, such as grooves or channels, which extend inwardly from the lower surface of the table top. Advantageously, the strengthening members may be sized and configured to strengthen and/or increase the rigidity of specific portions of the table top. In particular, the strengthening members may be used to strength a portion of the table top that extends beyond a perimeter or outer portion of the frame.

In contrast, some conventional table tops have a tendency to undesirably bend, twist or flex if a load or force is applied. In particular, the portion of the table top that extends beyond the frame may bend or deform when a force is applied. Specifically, these conventional table tops may have a hinge point or area that facilitates bending of the table top proximate the portion of the table top that extends beyond the frame. Thus, these known tables may disadvantageously have a structure or configuration that allows the table top to bend at or near the portion of the table top that extends beyond the frame. The disclosed strengthening members, however, may help prevent this undesirable flexing or bending of the table top.

Still another aspect is a table top that may include strengthening members that are sized and configured to support a portion of the table top extending beyond a portion of the frame. The strengthening members may be disposed at an angle, such as perpendicular, relative to the frame. The strengthening members may also have different sizes, such as lengths and/or widths, depending, for example, upon the positioning of the strengthening members relative to the frame. In addition, one or more of the strengthening members may have the same size. For example, if the table top has a round configuration, two or more of the strengthening members may have generally similar shapes, sizes, configurations and arrangements. The strengthening members may be aligned in generally parallel planes and disposed at a right angle relative to the frame. Advantageously, the strengthening members may help prevent the portion of the table top extending outwardly from the frame from bending if a hinge point is generally aligned with the edge of the frame. It will be appreciated the strengthening members may be disposed at an angle relative to a perimeter or outer edge of the table top, and one or more strengthening members may be disposed at different angles relative to other strengthening members, the table top and/or the frame.

Yet another aspect is a table top that may include strengthening members that are at least partially disposed between an outer portion of the table top and the frame. For example, the strengthening members may extend between an outer lip or perimeter of the table top and the nearest portion of the frame. The strengthening members may also be sized and configured to support a specific portion of the table top. For instance, the strengthening members may be sized and configured to support the portion of the table top that extends outwardly from the frame. Additionally, the strengthening members may be sized and configured to at least partially counteract a bending or hinge point, which may be created by the portion of the table top that extends beyond the frame. For instance, if the table top has a tendency to bend along a side rail or outer portion of the frame, the strengthening members may be sized and configured to resist bending of the table top. The strengthening members may advantageously be disposed at an angle relative to the hinge point to help prevent deflection of the table top.

Still yet another aspect is a table top that may include strengthening members disposed along or at least proximate first and second portions of the table top. For example, the table top may include a first set of one or more strengthening members that extends beyond a first portion of the frame and a second set of one or more strengthening members that extends beyond a second portion of the frame. The first set of one or more strengthening members may be used to support the first portion of the table top and the second set of one or more strengthening members may be used to support the second portion of the table top. For instance, the first and second sets of strengthening members may be disposed on opposing sides of the table top, aligned in generally parallel planes and spaced apart by a distance. While the strengthening members may be on opposing sides of the table top, the strengthening members may be used to strengthen any desired portions of the table top. In addition, the strengthening members may have different shapes, sizes, configurations and/or arrangements. For example, strengthening members in one portion of the table top may have a first configuration while strengthening members in another portion of the table top may have a different configuration. Thus, the strengthening members may have different characteristics depending, for example, upon the portion of the table top to be supported. For instance, if a relatively small portion of the table top extends beyond the frame, then the strengthening members may have a first configuration. On the other hand, if a larger portion of the table top extends beyond the frame, then the strengthening members may have a second configuration.

A further aspect is a table top that may include strengthening members which provide increased support for portions of the table top. For example, one or more strengthening members may be generally disposed between the frame and the perimeter or outer lip of the table top. The strengthening members may also extend towards the perimeter or outer lip of the table top and towards a central portion of the table top. The strengthening members may also include one or more surfaces that are sized and configured to contact, engage or be disposed at least proximate the frame and/or legs. In particular, the strengthening members may include one or more surfaces that contact, engage or are disposed at least proximate a side rail, crossbar, cross member and/or portion of the legs or support pedestals. Additionally, the strengthening members may be disposed along an axis that is disposed at an angle relative to the frame and/or the legs.

A still further aspect is a table top that may include strengthening members that are sized and configured to help prevent a moment arm from being created by a portion of a table top that extends beyond a portion of the frame. For example, the portion of the table top that extends beyond the frame may have a tendency to bend or rotate relative to the frame. The strengthening members may help prevent the moment arm from being created and/or help prevent the table top from deflecting relative to the frame. For instance, the strengthening members may be at an angle, such as between 45°, 60° and 90° relative to the frame, to help prevent a moment arm from being created. Additionally, if a hinging or pivot point is created by a portion of the table top extending beyond the frame, then the strengthening members are preferably at an angle, such as between 45°, 60° and 90°, to help prevent bending of the table top.

These and other aspects, features and advantages of the present invention will become more fully apparent from the following brief description of the drawings, the drawings, the detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limits its scope. Additionally, it will be appreciated that while the drawings may illustrate preferred sizes, scales, relationships and configurations of the invention, the drawings are not intended to limit the scope of the claimed invention. The invention will be described and explained with additional specificity and detail through the use of the accompanying drawings in which:

DETAILED DESCRIPTION OF THE PREFERRED EMBODIMENTS

Figure 1:
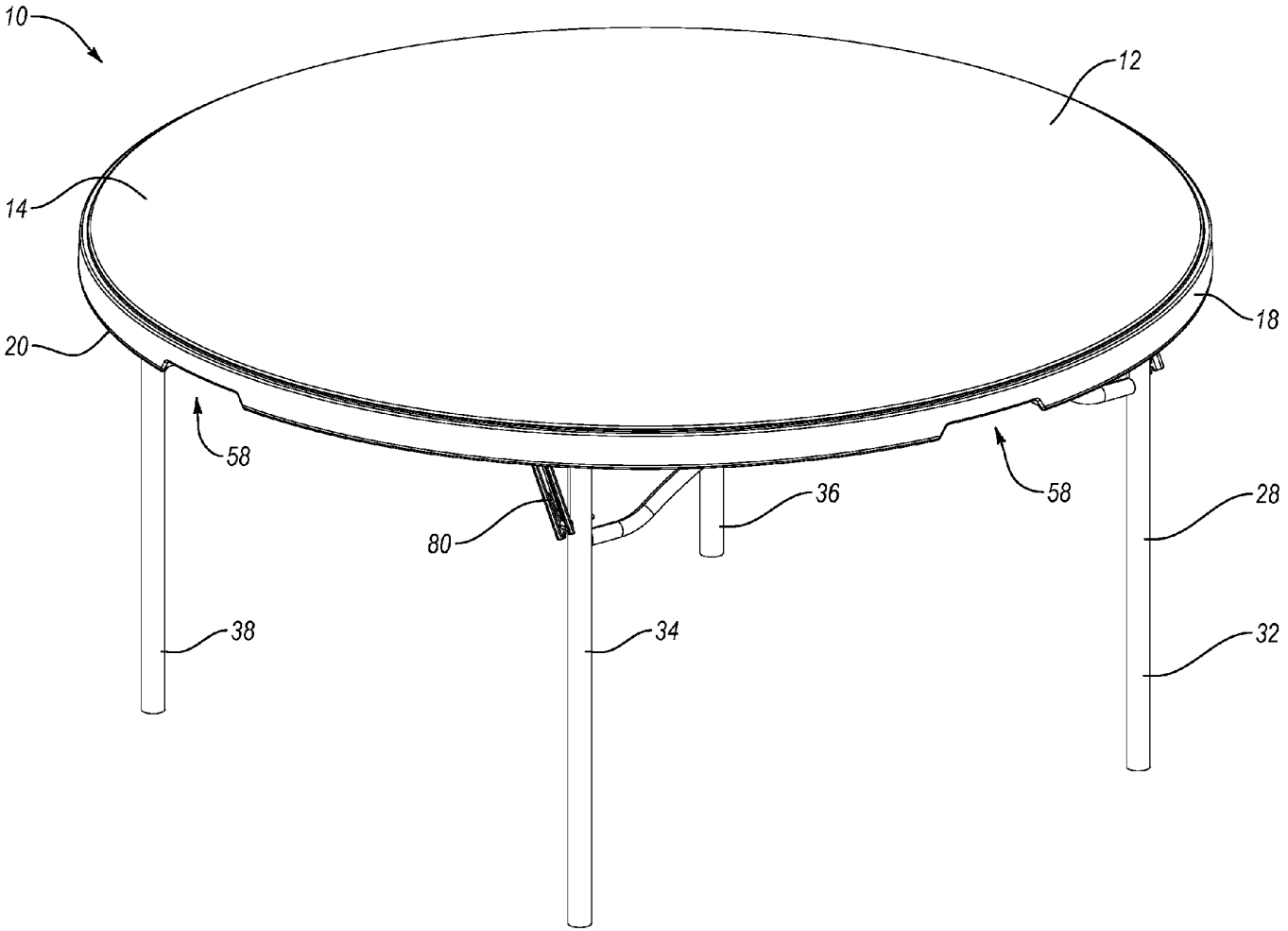
FIG. 1 is an upper perspective view of an exemplary table.

The present invention is generally directed towards tables. The principles of the present invention, however, are not limited to tables. It will be understood that, in light of the present disclosure, the tables disclosed herein can be successfully used in connection with other types of furniture and structures.

Additionally, to assist in the description of the tables, words such as top, bottom, front, rear, right and left are used to describe the accompanying figures. It will be appreciated, however, that the tables can be located in a variety of desired positions and the tables can have various suitable shapes, sizes and configurations. A detailed description of exemplary embodiments of the table now follows.

As shown in FIGS. 1-8, an exemplary embodiment of a table 10 includes a table top 12 with an upper surface 14 and a lower surface 16. The upper surface 14 of the table top 12 is preferably generally planar to create a relatively smooth and flat working surface, but the upper surface could also be textured and have other suitable shapes and configurations depending, for example, upon the intended use of the table. The table top 12 may also include an outer edge 18 that is disposed about a perimeter or periphery of the table top. All or a portion of the outer edge 18 of the table top 12 may be beveled, sloped, rounded and the like according to, for example, the intended design and/or aesthetics of the table 10.

The table top 12 may include a lip 20 disposed at least proximate the outer edge 18. The lip 20 preferably extends downwardly beyond the lower surface 16 of the table top 12 and the lip may be aligned with and/or form a part of the outer edge 18. The lip 20 may have a generally U-shaped configuration with an inner portion 22, an outer portion 24 and a lower portion 26. Preferably, the inner portion 22 is disposed towards an interior portion of the table top 12 and the outer portion 24 is disposed towards an outer portion of the table top. In particular, the outer portion 24 of the lip 20 may be generally aligned with the outer edge 18 of the table top 12, but all or a portion of the lip could also be spaced inwardly from the outer edge. The lip 20 may also include a hollow interior portion and the lip may be integrally formed with the table top 12 as part of a unitary, one-piece construction. It will be appreciated, however, the lip 20 does not have to be formed as a unitary component of the table top 12 and the lip is not required.

As shown in the accompanying figures, the table top 12 preferably has a generally round or circular configuration. For example, the table top 12 may have a diameter in the range between about five feet and about six feet. The table top 12 may also be larger and could have a diameter more than six feet, such about seven feet, about eight feet, or more. In addition, the table top 12 may be smaller and could have a diameter less than five feet, such as about four feet, about three feet, or less. One of ordinary skill in the art will appreciate that the table top 12 can be larger or smaller according, for example, to the intended use of the table 10. Additionally, the table top 12 may have other suitable shapes and configurations such as oval, elliptical, rectangular, square and the like.

The table top 12 is preferably constructed from a lightweight material and, more preferably, the table top may be constructed from plastic, such as high density polyethylene. The plastic table top 12 may be desirably formed by a blow-molding process because, for example, it may allow a strong, lightweight, rigid and sturdy table top to be quickly and easily manufactured. Advantageously, the blow-molded plastic table 12 top may be lightweight because it may include a hollow interior portion that is formed during the blow-molding process. It will be appreciated that the hollow interior portion of the table top 12 could be filled, for example, with a material such as foam and the hollow interior portion is not required.

The blow-molded plastic table top 12 may be relatively durable, weather resistant, temperature insensitive, corrosion resistant, rust resistant and long-lasting. One of ordinary skill in the art, however, will appreciate that the table top 12 does not have to be constructed from blow-molded plastic and other suitable materials can be used to construct the table top such as other types of plastics, polymers and synthetic materials. In addition, the table top 12 may be constructed from other materials with desirable characteristics such as wood, metal, fiberglass, ceramics, graphite and the like. Further, other types of processes may be used to construct the table top 12 such as injection molding, rotary molding and the like.

The upper surface 14 of the table top 12 is preferably generally spaced apart from the lower surface 16 by a given distance and these two spaced apart surfaces may help create a rigid and strong table top. Preferably, the upper surface 14 and the lower surface 16 of the table top 12 are separated by a generally constant distance so that the surfaces are generally aligned in parallel planes. The upper surface 14 and the lower surface 16, however, do not have to be spaced apart by a generally constant distance and, in fact, the upper and lower surfaces could be separated by any desired distance.

The table top 12 may also include one or more structures or features that may be sized and configured to increase the strength and rigidity of the table top. For example, the table top 12 may include one or more depressions, which are also known as tack-offs or kiss-offs, that are sized and configured to increase the strength and rigidity of the table top. Advantageously, the depressions may be integrally formed as part of a unitary one-piece table top 12, such as during the blow-molding or other molding processes.

The depressions may be disposed in the lower surface 16 of table top 12 and may be sized and configured to increase the strength and structural integrity of the table top. The depressions may also be sized and configured to help create a table top 12 with more uniform characteristics such as strength, rigidity and surface smoothness. The depressions preferably extend towards the upper surface 14 of the table top 12 and the ends of the depressions may contact or engage an inner portion of the upper surface of the table top. The ends of the depressions may be spaced apart from the inner portion of the upper surface 14 of the table top 12 depending, for example, upon the desired characteristics of the table.

The depressions may cover substantially the entire lower surface 16 of the table top 12, but it will be appreciated the depressions may cover only a portion of the table top. Additionally, it will be appreciated that the depressions could be formed in any desired portion of the table top 12. For example, one or more depressions may be formed in the upper surface 14 of the table top 12 and one or more depressions may be formed in the lower surface 16 of the table top, and these opposing depressions may be generally aligned. At least a portion of these opposing depressions may contact or engage each other, but the opposing depressions do not have to touch or engage. One or more depressions may also be formed in other portions of the table top 12 such as the lip 20.

The depressions are preferably arranged into a predetermined pattern or array, which may help increase the strength and structural integrity of the table top 12. In addition, the depressions may be closely spaced such that the distance between adjacent depressions is minimized. If the distance between adjacent depressions is minimized, for example, the unsupported areas of the upper surface 14 of the table top 12 may also be minimized. This may increase the smoothness of the upper surface 14 of the table top 12. In addition, minimizing the distance between adjacent depressions may increase the structural integrity and strength of the table top 12. The closely spaced depressions may also help create a table top 12 with more uniform characteristics. Thus, the closely spaced depressions may create a table top 12 with greater strength, improved structural integrity and an upper surface 14 with increased smoothness.

In addition, the depressions are preferably arranged in a predetermined pattern with a generally constant and uniform spacing so that the table top 12 has generally uniform characteristics. In particular, the depressions are preferably arranged into a generally uniform pattern across at least a majority of the lower surface 16 of the table top 12 so the strength, structural integrity and/or other characteristics of the table top are generally uniform. Thus, the table top 12 may have fewer, if any, weak or unsupported portions which may decrease the strength and structural integrity of the table top. The depressions may also be used to create a table top 12 with generally uniform characteristics. It will be appreciated that the depressions may also have a non-uniform spacing depending, for example, upon various features that are formed in the table top 12 or upon the intended use of the table 10. It may be desirable, however, for these various features that are formed in the table top 12 to be sized and configured such that they do not significantly disturb or disrupt the generally uniform pattern of depressions. Additional information about exemplary depressions that may be used in connection with the table top 12 are disclosed in U.S. Pat. Nos. 7,069,865; 7,160,215; 7,171,910; 7,331,297; 7,476,164; 7,634,970; 7,644,667; 7,972,225 and 8,006,630, which are incorporated by reference in their entireties.

Advantageously, the increased structural integrity and strength of the table top 12 may allow the outer wall thickness of the table top to be decreased, which may allow the table top to be constructed with less material. For example, if the table top 12 is constructed from blow-molded plastic and the outer wall thickness is reduced, then less plastic may be used to construct the table top. Because less plastic may be used to construct the table top 12, the cost of the table 10 may be decreased. In addition, the table top 12 may cool more quickly during the manufacturing process because of the decreased outer wall thickness and/or smaller amount of plastic used to construct the table top. This may allow the table top 12 to be removed from the manufacturing mold more quickly and it may allow the table top to be removed at a higher temperature because the thinner outer wall may dissipate heat more rapidly. Significantly, manufacturing efficiency may be increased because the time required to construct the table top 12 may be decreased. While the table top 12 may include one or more depressions, which may be integrally formed with the table top during the blow-molding process, it will be appreciated that depressions are not required and the table top does not have to be manufactured from blow-molded plastic.

As seen in FIGS. 1-2 and 4-8, the table 10 may include one or more supports, such as leg assemblies 28, 30, which may be sized and configured to support the table top 12 above a surface. The leg assemblies 28, 30 may include legs or supports 32, 34, 36, 38, and the legs may be connected by one or more connecting members. For example, a first connecting member 40 may connect the legs 32, 34 and a second connecting member 42 may connect the legs 36, 38. In addition, one or more cross members may interconnect the legs 32, 34, 36, 38. For example, a first cross member 44 may interconnect the legs 32, 34 and a second cross member 46 may interconnect the legs 36, 38. Advantageously, the connecting members 40, 42 and/or cross members 44, 46 may help create a sturdy and secure table 10.

The leg assemblies 28, 30 may be movable between an extended or use position and a collapsed or storage position relative to the table top 12, which may facilitate moving and/or storage of the table 10. In particular, the legs 32, 34, 36, 38 may be disposed at least proximate the lower surface 16 of the table top 12 in the collapsed position. The legs 32, 34, 36, 38 may extend outwardly from the table top 12 in the use position. It will be appreciated the legs assemblies 28, 30; the legs 32, 34, 36, 38; the connecting members 40, 42; and the cross members 44, 46 may have other suitable shapes, sizes, configurations and arrangements depending, for example, upon the intended use of the table 10. It will also be appreciated that the table 10 may have any suitable number of leg assemblies, legs, connecting members and/or cross members depending, for example, upon the type and configuration of the table 10.

Figure 2:
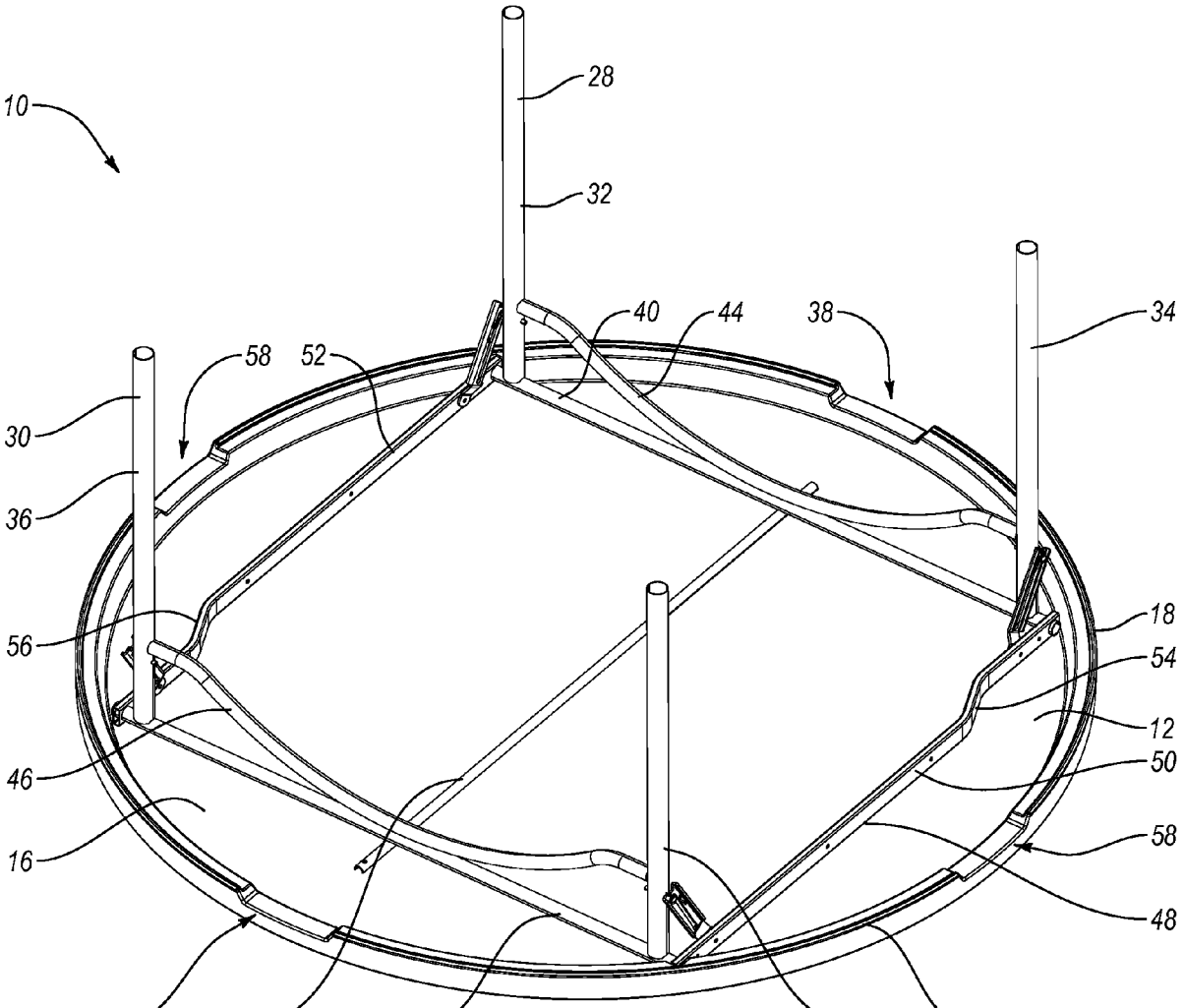
FIG. 2 is a lower perspective view of the table shown in FIG. 1.
Figure 3:
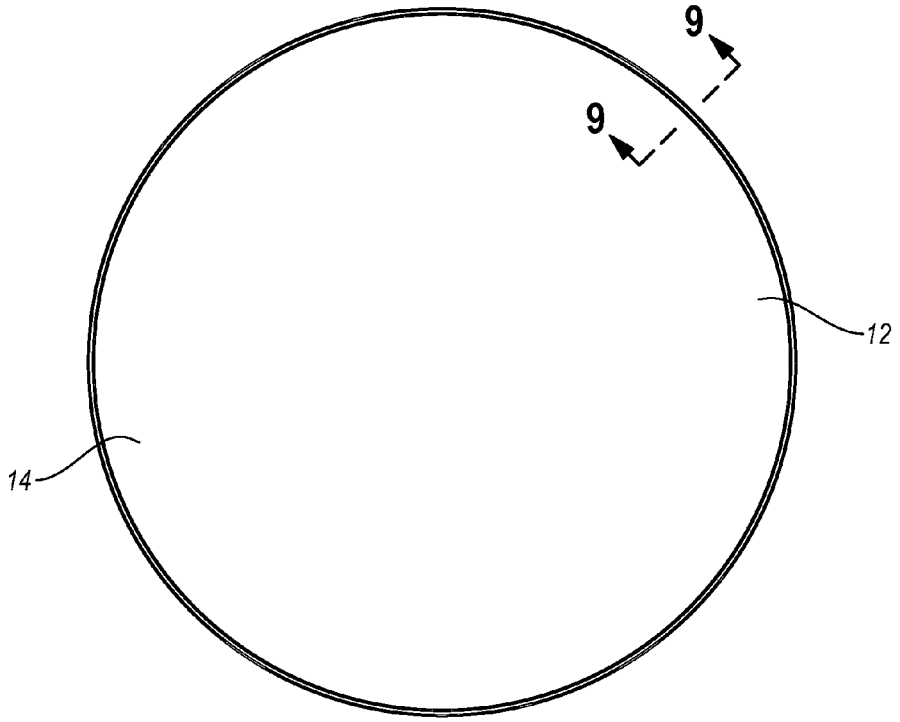
FIG. 3 is a top view of the table shown in FIG. 1.
Figure 4:
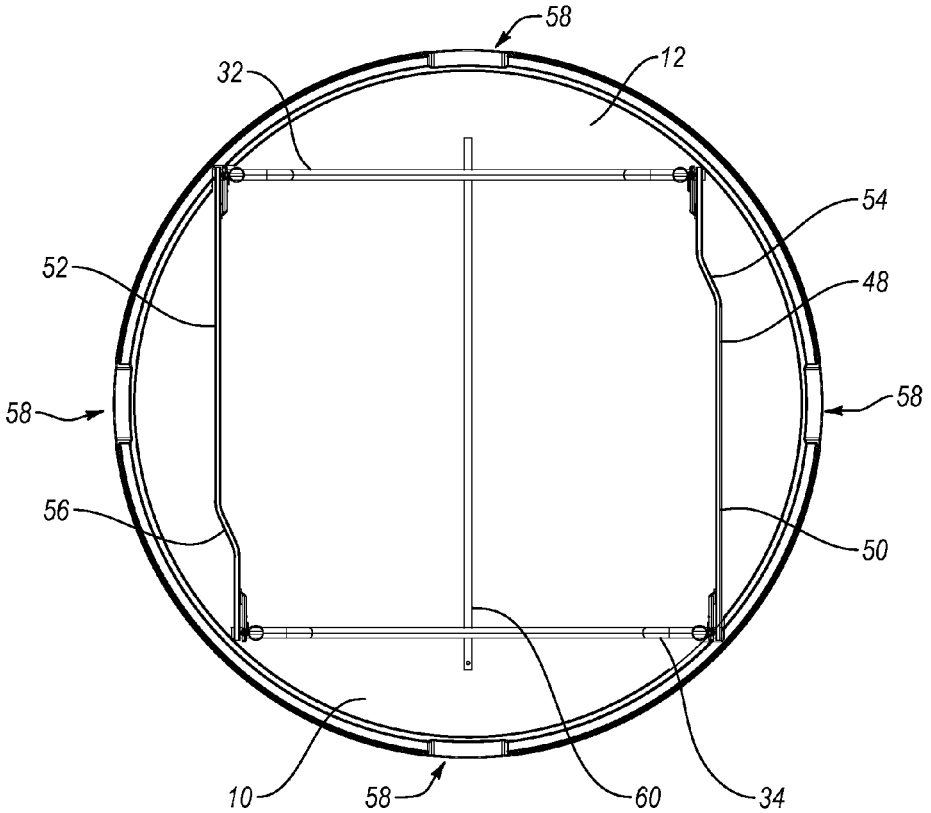
FIG. 4 is a bottom view of the table shown in FIG. 1.
Figure 5:
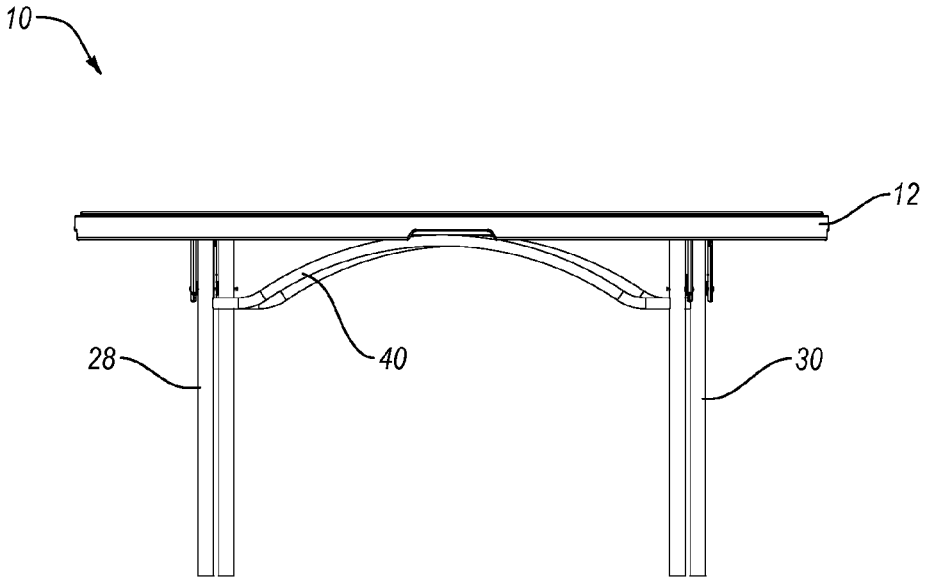
FIG. 5 is a right side view of the table shown in FIG. 1.
Figure 6:
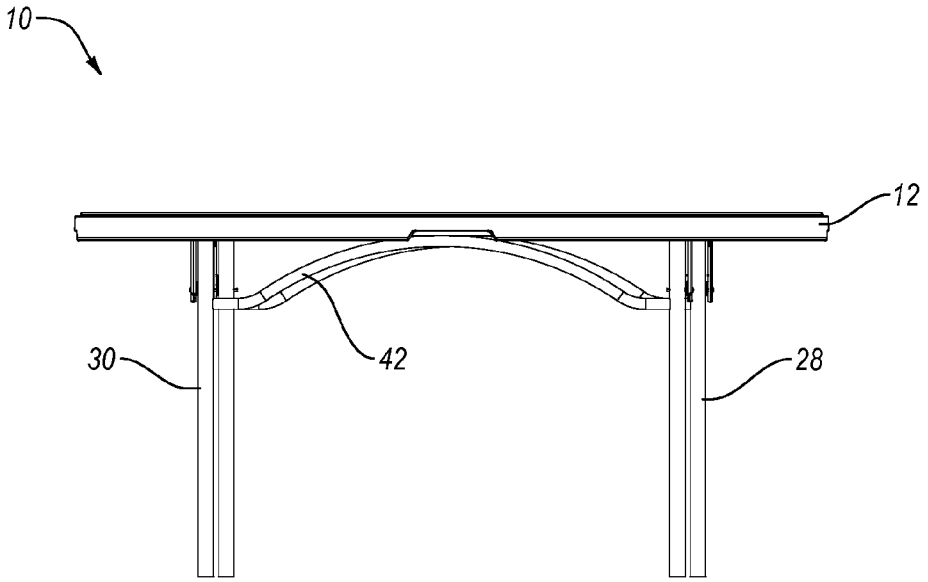
FIG. 6 is a left side view of the table shown in FIG. 1.

The table 10 may further include a frame 48 that is connected to the table top 12. As seen in FIGS. 2 and 4, the frame 48 may connected to the lower surface 16 of the table top 12 and the frame may include one or more rails, channels, support members and the like. For example, the frame 48 may include rails, such as side rails 50, 52, and the side rails may be separated by a distance. Specifically, the side rails 50, 52 may be disposed near opposing portions of the table top 12 and the side rails may be at least partially disposed proximate the outer edge 18. In particular, the ends of the side rails 50, 52 may be disposed at least proximate the outer edge 18 while the center portion of the side rails may be spaced apart from the outer edge by a gap or distance. The side rails 50, 52 may have a length that is generally equal to or greater than a majority of a length, radius and/or diameter of the table top 12. The side rails 50, 52 may also have a length significantly less than a length, radius and/or diameter of the table top 12.

The leg assemblies 28, 30 may be connected to the side rails 50, 52 of the frame 48. In particular, the connecting members 40, 42 of the leg assemblies 28, 30 may be connected to the side rails 50, 52 of the frame 48. Preferably, the connecting members 40, 42 are pivotally connected to the side rails 50, 52 to allow the leg assemblies 28, 30 to be moved between the extended and collapsed positions. The leg assemblies 28, 30 may be connected to opposing ends the side rails 50, 52 and the leg assemblies may be generally disposed between the side rails. Advantageously, when the leg assemblies 28, 30 are in the collapsed positions, the leg assemblies may be generally disposed between and coplanar with the side rails 50, 52.

As seen in FIGS. 2 and 4, the ends of the connecting members 40, 42 may be disposed within or extend through openings in the side rails 50, 52 of the frame 48, which may allow the leg assemblies 28, 30 to be pivotally connected to the table top 12. The connecting members 40, 42 may also be connected to the frame 48 in other suitable configurations and arrangements, such as shown in U.S. Pat. No. 7,100,518, which is incorporated by reference in its entirety. The connecting members 40, 42 may also be connected to other portions of the frame 48, the table top 12 and/or the table 10.

The leg assemblies 28, 30 may be offset and that may allow longer legs 32, 34, 36, 38 to be used in connection with the table 10. The offset configuration may also allow the same leg assemblies 28, 30 to be used on either side of the table 10, which may facilitate manufacturing and/or assembly of the table. The offset leg assemblies 28, 30 may further allow the legs 32, 34, 36, 38 to be disposed in an adjacent configuration when the legs are in the collapsed position.

The frame 48 may be used to offset the leg assemblies 28, 30. For instance, the side rails 50, 52 may include angled portions 54, 56 that allow the leg assemblies 28, 30 to be offset. As best seen in FIG. 2, the angled portions 54, 56 may be disposed between two generally straight sections of the side rails 50, 52, and the angled portions may be disposed towards an end of the side rails. In particular, the angled portions 54, 56 may be disposed between a first generally straight section that has a length generally equal to or greater than a length of an adjacent leg and a second generally straight section that has a shorter length. The angled portions 54, 56 preferably offset the first and second sections of the side rails 50, 52 by an amount slightly larger than the width or diameter of the legs 32, 34, 36, 38. Thus, the legs 32, 34 of the leg assembly 28 may not be aligned with the legs 36, 38 of the leg assembly 30. Additionally, when the leg assemblies 28, 30 are in the collapsed position, this may allow the leg 32 to be disposed adjacent to the leg 36, the leg 34 to be disposed adjacent to the leg 38, the legs to be disposed at least proximate the lower surface 16 of the table top 12, and the legs to be generally aligned in the same plane.

As mentioned above, the lip 20 may be disposed about the outer periphery of the table top 12 and the lip may be generally aligned with the outer edge 18 of the table top. In addition, the lip 20 may have a circular or ring-shaped configuration if the table 10 has a round table top 12. As best seen in FIGS. 1 and 2, the table top 12 may include one or more handles 58 which may be openings or recesses disposed in the lip 20. Advantageously, the handles 58 may facilitate moving and carrying of the table 10. In addition, the handles 58 may facilitate separating the tables 10 in a stacked and/or nested configuration, which is described in more detail below.

The table 10 may include four exemplary handles 58 that are spaced equidistant about the perimeter of the table top 12. For example, two handles 58 may be disposed proximate a midpoint of the side rails 50, 52 and two handles may be disposed proximate a midpoint of the connecting members 40, 42. In this configuration, the handles 58 are spaced as far apart as possible from the ends of the side rails 50, 52, and the ends of the connecting members 40, 42. In addition, the handles are spaced as far apart as possible from the body of the side rails 50, 52 and the body of the connecting members 40, 42. While the handles 58 may be symmetrically disposed about the perimeter 18 of the table top 12, the table 10 could include any suitable number of handles in any desired locations.

While the handles 58 shown in the accompanying figures illustrate the handles extending the entire width of the lip 20, it will be understood the handles may be disposed in only a portion of the lip. For example, the handles 58 may be formed only in the outer portion 24 of the lip 20 and not the inner portion 22. In addition, the handles 58 may be formed in the inner portion 22, the outer portion 24 and the lower portion 26 of the lip 20, but the handles may have a height significantly less than the height of the lip. In particular, the handles 58 may have a height less than about fifty percent (50%) of a height of the lip 20, such as in the range of about thirty to about forty (30-40%) of the height of the lip. The handles 58 could also have a smaller height such as about twenty-five (25%) or less of the height of the lip, but the handles could also be larger with a height in the range between about sixty percent (60%), seventy percent (70%) or more.

The table 10 may also include a central cross member 60 that spans at least a portion of the table top 12. The cross member 60 is preferably centrally located and at least partially disposed between the table top 12 and the leg assemblies 28, 30 and/or the frame 48. For example, as shown in FIG. 2, the cross member 60 may consist of a rod or tube and a portion of the cross member may be disposed in a recess in the lower surface 16 of the table top 12. In addition, the cross member 60 may be disposed or sandwiched between the connecting members 40, 42 of the leg assemblies 28, 30 and the table top 12. The cross member 60 may be designed to allow the leg assemblies 28, 30 to freely move between the collapsed and extended positions, and the cross member may contact the connecting members 40, 42, when a load or force is applied to the table top 12. The cross member 60 may also be designed to provide increased support for a center portion of the table top 12. It will be appreciated that the cross members 60 may have other suitable configurations and any number of cross members may be utilized depending, for example, upon the configuration and/or intended use of the table 10. It will also be appreciated that the cross member 60 is not required.

The table 10 is preferably sized and configured to be stacked with one or more additional tables. In particular, the table 10 is preferably sized and configured to be stacked with other tables having the same general size, shape, configuration and arrangement. Additionally, the table 10 is preferably sized and configured to nest with other similar tables to reduce the height of the stacked tables, which may allow the tables to be shipped, stored and transported in a smaller area. This may result in significant cost savings to the manufacturer, for example, because less storage space may be required and a substantial reduction in transportation costs may be achieved.

Figure 9:
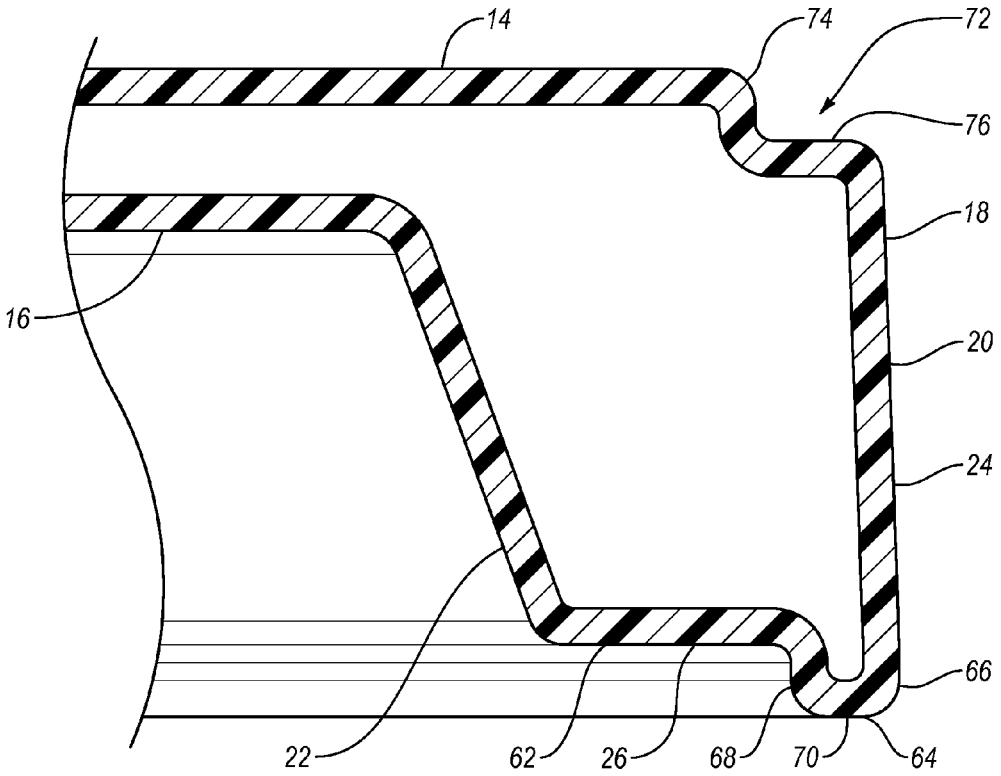
FIG. 9 is an enlarged cross-sectional side view along lines 9-9 of a portion of the table shown in FIG. 3.
Figure 11:
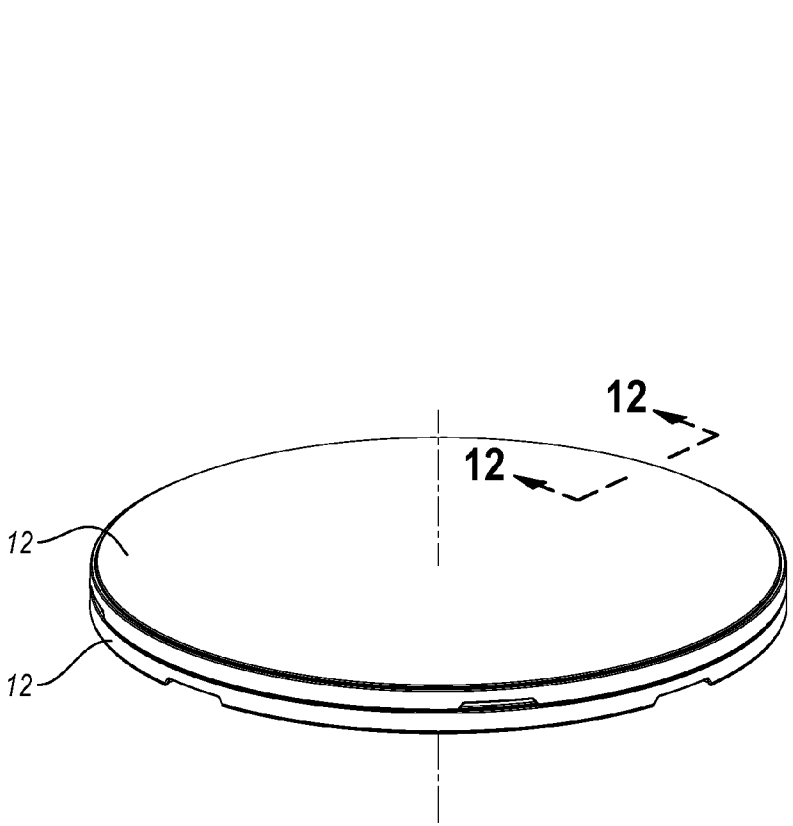
FIG. 11 is an upper perspective view of the two tables shown in FIG. 10, illustrating the tables an exemplary nested configuration.
Figure 10:
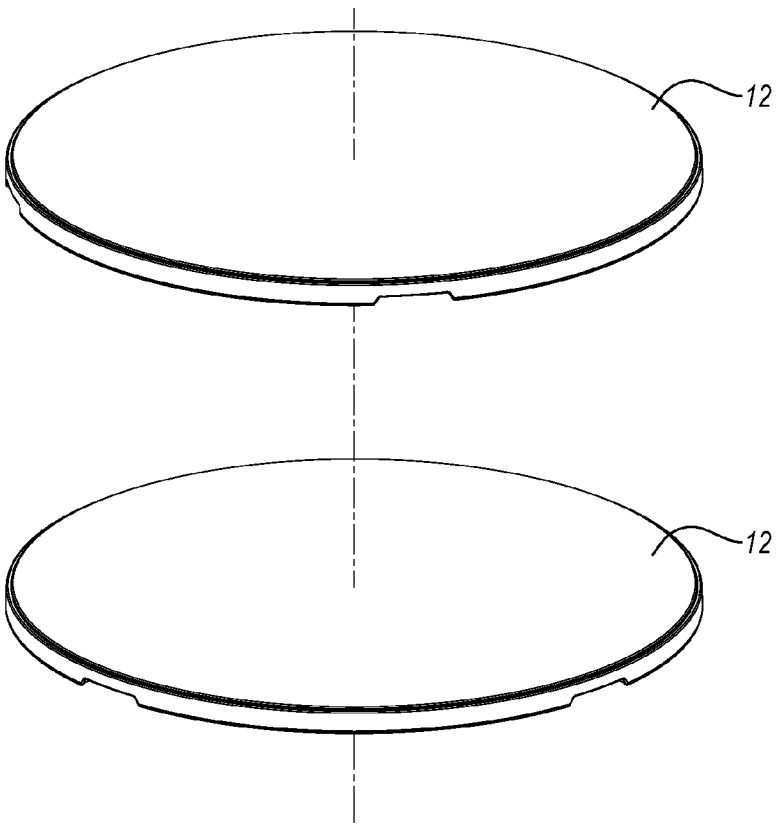
FIG. 10 is an upper perspective view of two exemplary tables, illustrating the tables in an aligned configuration, the tables spaced apart by a distance and the table legs in a collapsed position.
Figure 12:
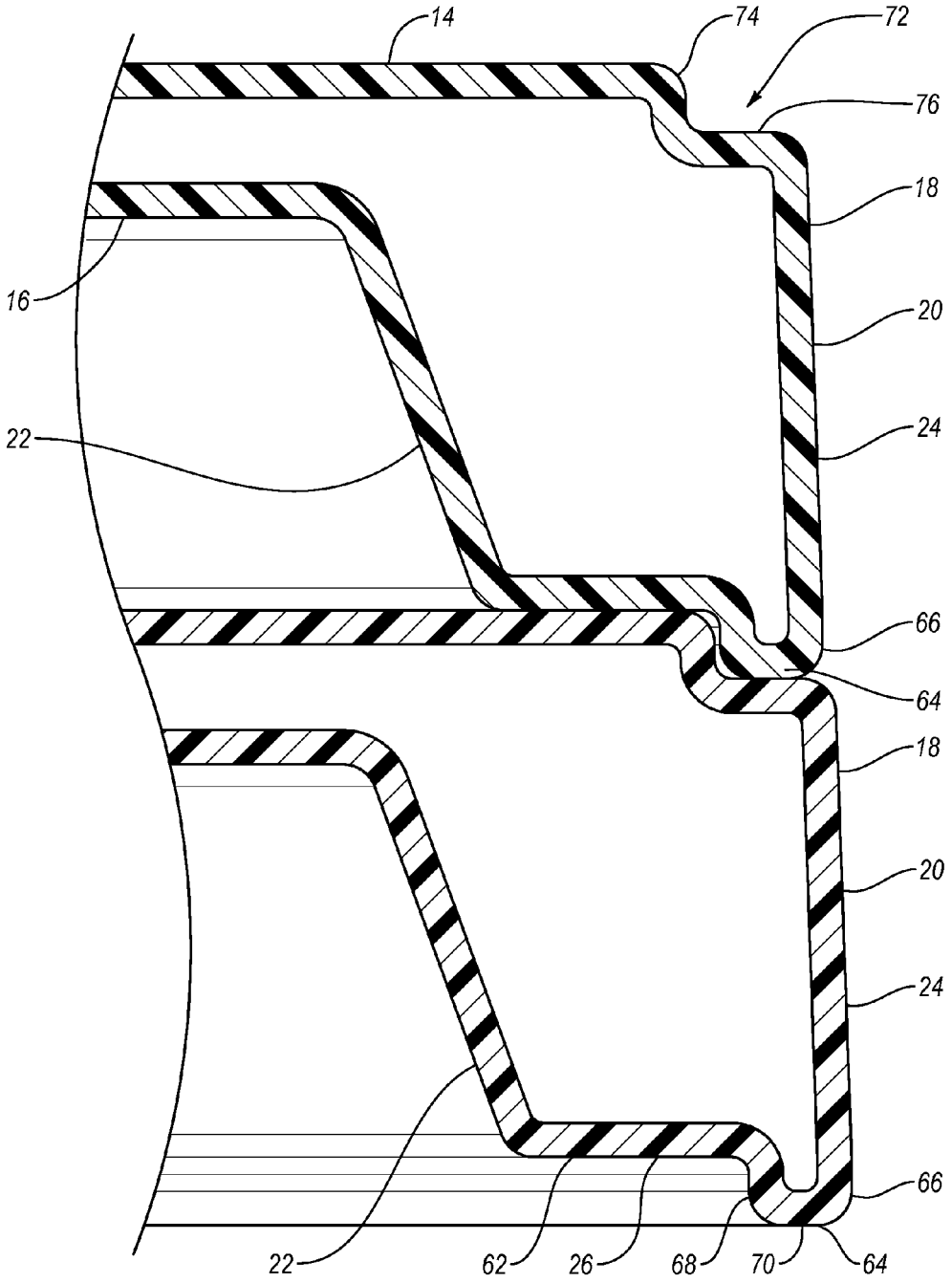
FIG. 12 is an enlarged cross-sectional side view along lines 12-12 of a portion of the two nested tables shown in FIG. 11.

The lip 20 is preferably sized and configured to facilitate stacking and nesting of the table 10. For example, as best seen in FIGS. 9 and 12, the inner portion 22 of the lip 20 may be disposed at an angle in the range between about 60° and about 75° relative to the lower portion 26 of the lip. The angle could also be larger, such as between about 80° and about 85°, or smaller, such as between about 45° and about 55°, if desired. The outer portion 24 of the lip 20 may be generally vertically disposed and it may form at least a portion of the outer edge 18 of the table top 12.

The inner and outer portions 22, 24 of the lip 20 may be separated by an average distance, which may be referred to as a thickness or width of the lip. The lip 20 may have a thickness in the range between about three-quarters (0.75) inch and about one and one-half (1.5) inches. In particular, the lip 20 may have a thickness of about one and one-quarter (1.25) inches. The lip 20 could also have a smaller width, such as about one-half (0.5 inches) or less, or a larger width, such as about two (2.0) inches or more. It will be appreciated that the size of the lip 20 may depend upon the size and/or intended use of the table 10.

The lower portion 26 of the lip 20 may have a generally planar configuration that is generally parallel to the upper and/or lower surfaces 14, 16 of the table top 12. The lower portion 26 of the lip may also include a contact surface 62 that is sized and configured to contact an adjacent table when the tables are nested together. In particular, the contact surface 62 may be sized and configured to contact an upper surface of the table top of the adjacent table when the tables are nested together. The contact surface 62 may be an interior portion of the lower portion 26 of the lip 20. If the table top 12 has a circular or round configuration, then the contact surface 62 may have a generally ring-shaped configuration and the contact surface may be disposed in a single plane. The contact surface 62 may be a generally smooth surface that is at least substantially free from projections to match the generally flat, level upper surface of the adjacent, nested table. It will be appreciated that the contact surface 62 may also have other configurations and arrangements depending, for example, upon the shape, contour or form of the adjacent, nested table.

In greater detail, the contact surface 62 may be a continuous surface that is at least substantially unbroken or uninterrupted, except for the optional handles 58. That is, the contact surface 62 may not include any openings or breaks other than for the handles 58. Further, the contact surface 62 may form at least a majority and perhaps substantially the entire lower portion 26 of the lip 20. Additionally, the contact surface 62 may have a rather large surface area and may be disposed at least proximate the circumference or outer perimeter of the table top 12. In particular, the contact surface 62 may have a ring-shaped configuration with an outer circumference that is generally equal to or slightly less than a circumference of the table top 12. Significantly, this large contact surface 62 may help prevent the adjacent, stacked table from being damaged. In addition, if the contact surface 62 is disposed about at least a majority of the table top 12, the contact surface may have a large surface area and that may allow the nested tables to support a significant amount of weight or force without being damaged because the load may be spread out over a large area. Further, if the contact surface 62 is disposed towards an inner portion of the lower portion 26 of the lip 20, this may facilitate contact with the upper surface of the adjacent, stacked table. It will be understood that the contact surface 62 may also be formed by other suitable portions of the lip 20 and/or table top 12.

The lower portion 26 of the lip 20 may also include an engaging portion 64 which may extend outwardly from the lower portion of the lip. In particular, the engaging portion 64 may extend downwardly from an outer portion of the lower portion 26 of the lip 20. In addition, the engaging portion 64 may be disposed adjacent to the contact surface 62. For example, if the contact surface 62 is formed by an inner portion of the lower portion 26 of the lip 20, the engaging portion 64 may be formed by an outer portion of the lower portion of the lip. Advantageously, if the contact surface 62 and engaging portion 64 are disposed next to each other, then multiple adjacent surfaces may contact or abut when the tables 10 are nested together.

In greater detail, the engaging portion 64 may be disposed about the outer edge 18 of the table top 12. In particular, the engaging portion 64 may include an outer portion 66 that is generally aligned with the outer portion 24 of the lip 20. While the engaging portion 64 may be disposed at least proximate the outer periphery of the lip 20 and/or the table top 12, the engaging portion may also be spaced inwardly. Advantageously, the engaging portion 64 may be a continuous structure that is disposed about the entire table top 12. In greater detail, as seen in FIG. 2, the engaging portion 64 may have a ring-shaped configuration and may be disposed about the entire perimeter of the table top 12 other than the optional handles 58. If desired, the engaging portion 64 may also be disposed in the optional handles 58. If the engaging portion 64 is at least substantially uninterrupted, then it may provide a large contact area with an adjacent, stacked table. The engaging portion 64 could also be a contiguous structure with one or more portions that abut or disposed proximate to each other. It will be appreciated that the engaging portion 64 could further include one or more portions that are spaced apart depending, for example, upon the configuration of the table top 12.

The engaging portion 64 may have a generally constant size, such as height and width, and it may have a generally U-shaped configuration. For example, the engaging portion 64 may include an inner portion 68 disposed towards the contact surface 62 and a lower portion 70 disposed between the inner portion and the outer portion 66. If the table top 12 has a round configuration and four handles 58 spaced equidistant, the engaging portion 64 may be divided into four quadrants that have generally the same size, shape, configuration and arrangement. Significantly, this may facilitate stacking and nesting of the tables 10 regardless of the orientation of the tables. That is, the tables 10 may be stacked and nested as long as the upper and lower portions of the table are aligned, and the tables may not need any other alignment.

The engaging portion 64 may be integrally formed with the lip 20 and/or the table top 12 as part of a unitary, one-piece construction. The engaging portion 64 may include a hollow interior portion that is in direct communication with the hollow interior portion of the lip 20 and/or the table top 12. The engaging portion 64 may also be formed from compression molded plastic. For example, if the table top 12 is formed from blow-molded plastic, then the engaging portion 64 may be compression molded during the blow-molding process. The compression molded engaging portion 64 may be formed by having the inner portion 68 and the outer portion 66 directly touch or contact so there is no gap or space between the inner and outer portions. Because the compression molded engaging portion 64 may have a double-wall thickness, it may create a stronger, more rigid and/or more impact resistant structure. The compression molded engaging portion 64 may be relatively thin because there is little or no space between the inner and outer portions 66, 68 of the engaging portion 64.

As mentioned above, the engaging portion 64 may have a generally uniform size and configuration. In addition, the engaging portion 64 may be directly adjacent to the contact surface 62. For example, the engaging portion 64 may have a width between about one-eighth (0.125) inch and about one-half (0.5) inch. In particular, the engaging portion 64 may have a width between about two-tenths (0.2) inch and about one-quarter (0.25) inch. The engaging portion 64 may have a height between about one-tenth (0.1) inch and about one-half (0.5) inch. Preferably, the engaging portion 64 has a height of about one-eighth (0.125) inch. Advantageously, the engaging portion 64 may be integrally formed with the table top 12 as part of a unitary, one-piece construction. In addition, the relatively small size of the engaging portion 64 may allow it to be created during the manufacturing process. For instance, the engaging portion 72 could be a protrusion that is formed during a molding process.

The contact surface 62 and the engaging portion 64 may have a generally constant size and configuration. Advantageously, the constant size of the engaging portion 64 may facilitate stacking and alignment of the tables 10. In addition, the constant size of the engaging portion 64 may allow the tables 10 to be stacked in different arrangements and orientations. The constant size of the contact surface 62 and the engaging portion 64 may allow weight or forces to be more evenly applied to stacked, nested tables. One of ordinary skill in the art will appreciate, after reviewing the disclosure herein, the contact surface 62 and engaging portion 64 may have other shapes, sizes, configurations and arrangements depending, for example, upon the type or intended use of the table 10.

The table top 12 may include a receiving or nesting portion 72 that is sized and configured to facilitate nesting of the tables. The receiving portion 72 may be at least partially disposed about the perimeter 18 and/or the upper surface 14 of the table top 12. Desirably, the receiving portion 72 may be disposed below a plane aligned with the upper surface 14 of the table top 12. The receiving portion 72 is preferably sized and configured to receive the engaging portion 64 of an adjacent, nested table. The receiving portion 72 may be integrally formed with the table top 12 as part of a unitary, one-piece construction during the molding process if, for example, the table top is constructed from molded plastic.

In greater detail, the receiving portion 72 may be disposed at least proximate the intersection of the upper surface 14 and the outer edge or perimeter 18. The receiving portion 72 may have a generally L-shaped configuration that is open on two sides, which may facilitate alignment and/or nesting of the tables 10. As shown in the accompanying figures, the receiving portion 72 may be a groove or channel with a height preferably between about one-tenth (0.1) inch and about one-half (0.5) inch, such as about one-eighth (0.125) inch, and a width that may be larger than the height by a factor such as two, three or more. For example, the width may be approximately two times the height such that, in this exemplary embodiment, if the height is about one-eighth (0.125) inch, then the width may be about one-quarter (0.25) inch. The height and the width may also be approximately the same. For instance, if the height is about one-eighth (0.125) or about one-quarter (0.25) inches, then the width may also be about one-eighth (0.125) or about one-quarter (0.25) inch. It will also be appreciated that the width may be smaller than the height. Thus, for example, if the height is about four-tenths (0.4) inch, then the width may be about three-tenths (0.3) inches or less. It will be understood that the height and the width may vary depending, for example, upon the intended use of the table 10.

The exemplary dimensions given above may be used in connection with a table top 12 that has a lip 20 with a height of about one and one-half (1.5) inches. It will be understood that the contact surface 62, the engaging portion 64 and/or the receiving portion 72 could also larger or smaller depending, for example, upon the size, shape, configuration or arrangement of the table top 12. It will also be understood that the table top 12, along with one or more of its various components and features, may have other suitable sizes, shapes, configurations and arrangements depending, for example, upon the intended use of the table 10.

As discussed above, the receiving portion 72 may be sized and configured to receive the engaging portion 64. In particular, the inner portion 68 of the engaging portion 64 may contact a sidewall 74 of the receiving portion 72 and/or the lower portion 70 of the engaging portion may contact a lower wall 76 of the receiving portion. For example, the inner portion 68 of the engaging portion 64 may have a height substantially equal to the height of the receiving portion 72 and the lower portion 70 of the engaging portion may have a width substantially equal to the width of the receiving portion. Advantageously, because the receiving portion 72 may be a strong and sturdy portion of the table top 12, the lower wall 76 may be able to support a relatively large amount of force or weight. In addition, the inner portion 68 of the engaging portion 64 may contact the sidewall 74 of the receiving portion 72 to help align and/or keep the tables 10 in the nested configuration. While the receiving portion 72 may be sized and configured to receive the engaging portion 64 of an adjacent, stacked table and the receiving portion may be disposed about the entire perimeter 18 of the table top 12, the receiving portion can also have other appropriate shapes, sizes, configurations and arrangements depending, for example, upon the engaging portion and/or the intended use of the table 10.

Advantageously, the nested tables may have multiple contact surfaces or areas. In addition, the contact areas and surfaces may be at least substantially continuous or uninterrupted, which may allow forces to be more evenly distributed. For example, the lower portion 70 of the engaging portion 64 may contact or abut the lower wall 76 of the receiving portion 72 of the adjacent, stacked table. The inner portion 68 of the engaging portion 64 may also contact or abut the sidewall 74 of the receiving portion 72 of the adjacent, stacked table. Additionally, the contact surface 62 may contact or abut the upper surface 14 of the adjacent, stacked table. The multiple contact areas may create multiple load bearing surfaces that allow a load or force to be shared or distributed over a larger area, which may permit the table 10 to support more weight and may help prevent damage to the table top 12.

Additionally, the engaging portion 64 and the receiving portion 72 may facilitate nesting of the tables 10, which may significantly reduce the height of a plurality of stacked tables. The reduction in height of the stacked tables 10 may be particularly advantageous when manufacturing, shipping, storing and displaying of the tables. Further, while the table top 12 may have the same general size, configuration and appearance as a conventional table top, the table top 12 may allow two or more stacked tables to be nested together.

For instance, the table top 12 may have a height measured from the upper surface 14 to the lower portion 70 of the engaging portion 64 that is about one and five-eighths (1.625) inches. Because the engaging portion 64 may be disposed in a receiving portion 72 of an adjacent, nested table 10, the table may only have a height of about one and one-half (1.5) inches in the stacked configuration. This may result in a decrease in height of a table 10 in the stacked configuration of more than seven percent (7%), which may allow seven percent more tables to be loaded into a conventional shipping container. This may also allow the same number of tables 10 to be disposed in an area that is seven percent smaller than a conventional table with the same size and shape.

Further, the contact surface 62, the engaging portion 64 and the receiving portion 72 may be integrally formed with table top 12 as part of a unitary, one-piece structure. Because these features may be integrally formed as part of the table top 12, the manufacturing process may be expedited. These features, however, are not required and the features do not have to be integrally formed in the table top as part of a unitary, one-piece structure.

Figure 7:
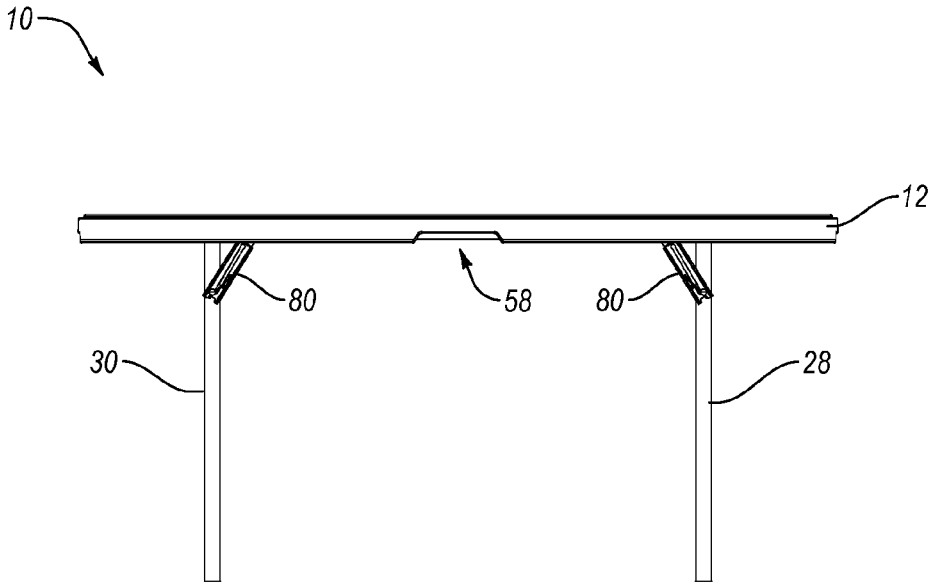
FIG. 7 is a front view of the table shown in FIG. 1.
Figure 8:
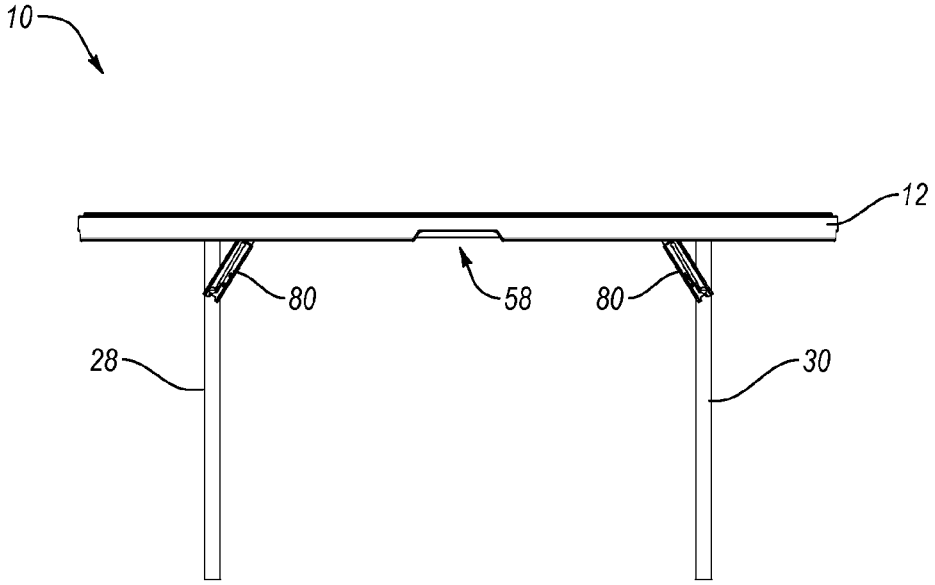
FIG. 8 is a rear view of the table shown in FIG. 1.

As seen in FIGS. 2, 7 and 8, the table may also include one or more braces 80 used in connection with the leg assemblies 28, 30. In particular, a brace 80 may be used in connection with each of the leg 32, 34, 36, 38. For example, one end of the brace 80 may be attached to the frame 48, such as the side rail 50 or 52, and the other end of the brace may be attached to one of the legs 32, 34, 36, 38. The brace 80 may be used to secure the legs 32, 34, 36, 38 in the extended position.

Figure 13:
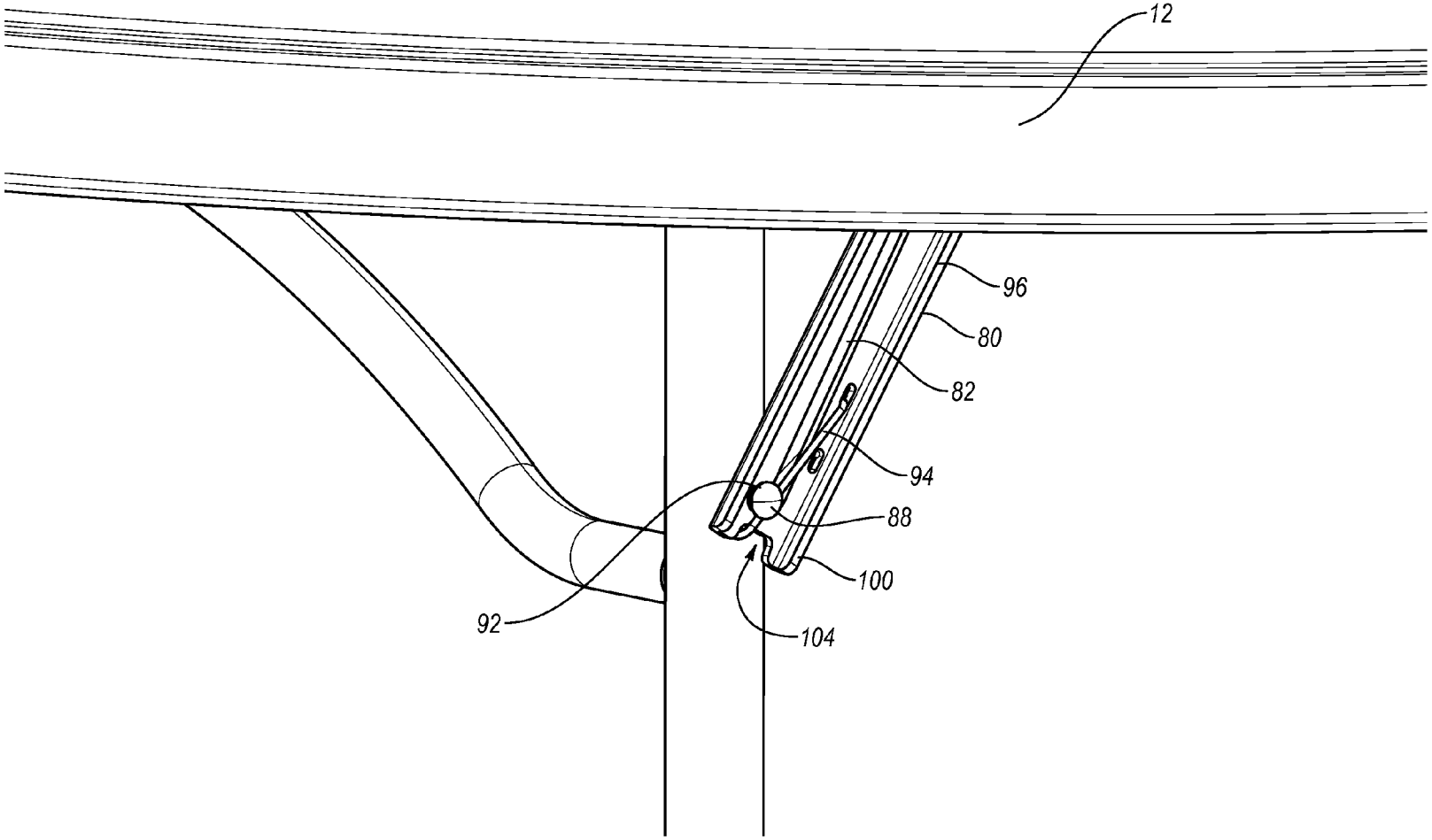
FIG. 13 is a side view of a portion of another exemplary table, illustrating a brace in a first portion.
Figure 14:
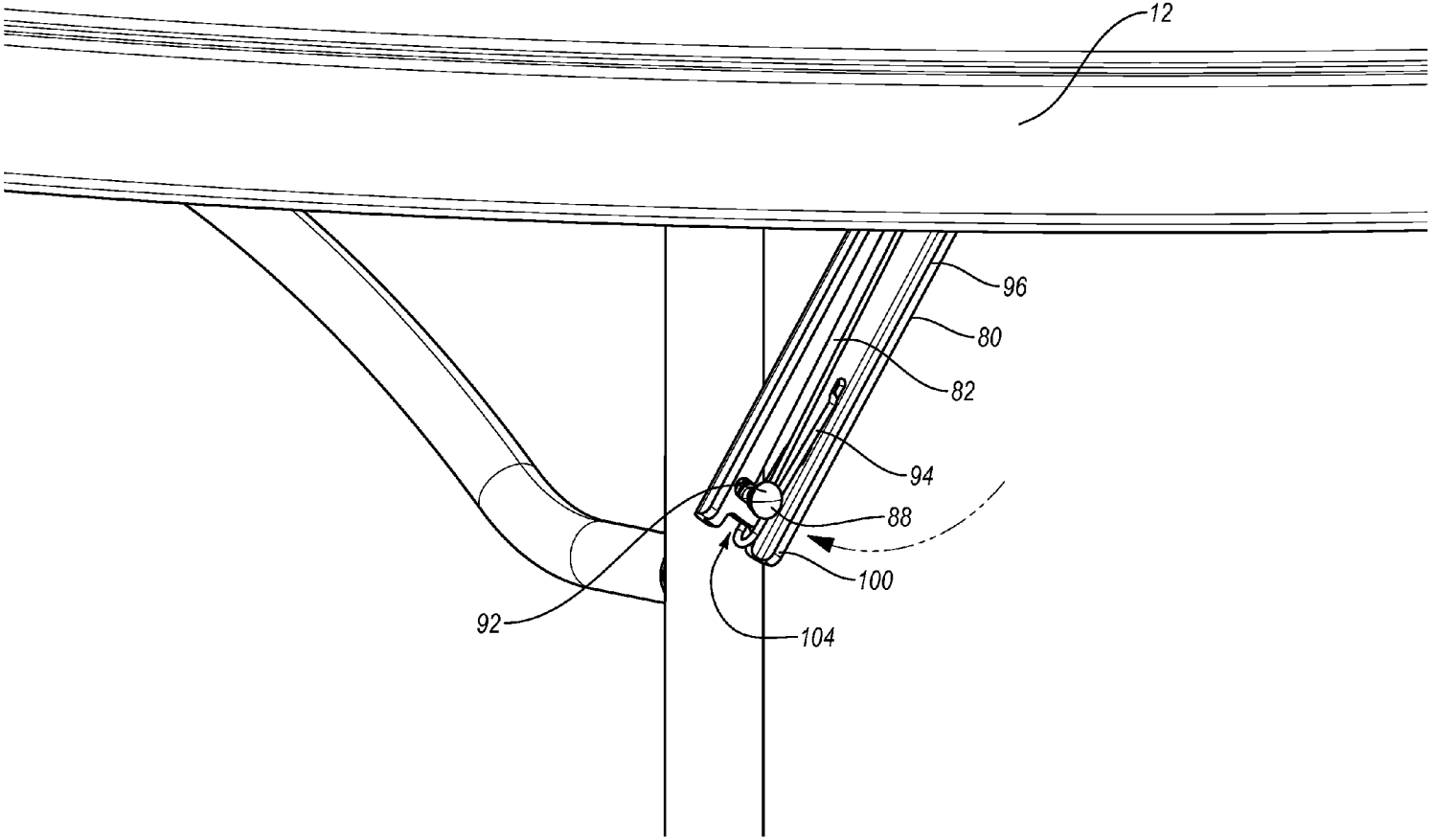
FIG. 14 is another side view of the portion of the table shown in FIG. 13, illustrating the brace in a second position.
Figure 15:
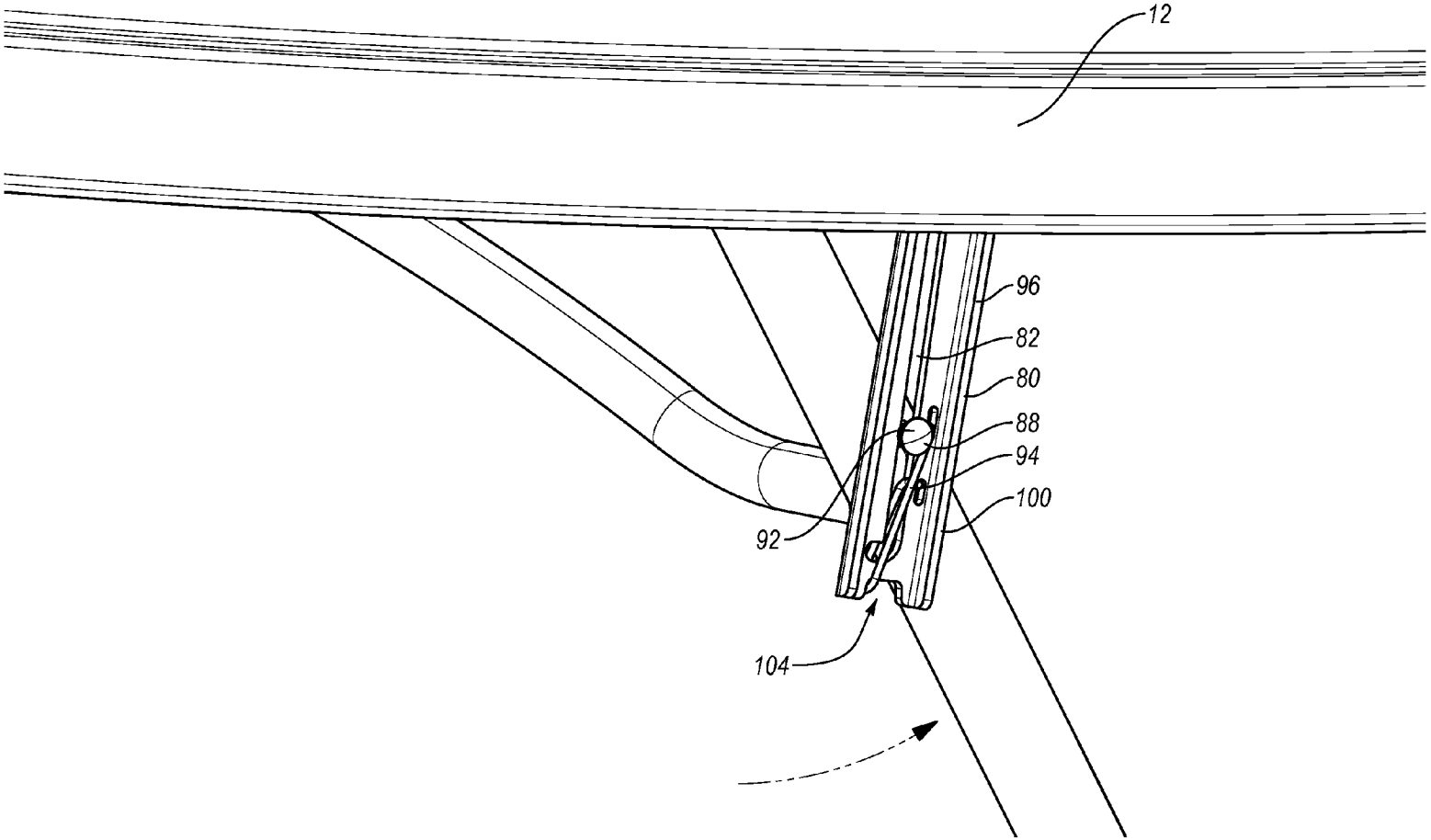
FIG. 15 is still another side view of the portion of the table shown in FIG. 13, illustrating the brace in a third position.

In greater detail, as seen in FIGS. 13-15, the brace 80 may include an elongated slot 82 with a body 84 and a receiving portion 86. An engaging member, such as a pin 88, may be connected to one of the legs 32, 34, 36, 38 and disposed within the slot 82. In particular, the pin 88 may have a generally cylindrical body 90 that is disposed within the slot 82 and an enlarged end or head 92. The brace 80 may also include a biasing member 94, such as a spring, which may be used to bias the brace into a desired position. For example, the biasing member 94 may be used to bias the brace 80 into a locked position, which may be used to lock the leg 32, 34, 36, 38 in the extended position. The brace 80 may be movable between a first position, such as shown in FIGS. 13 and 15, and a second position, such as shown in FIG. 14.

In further detail, the brace 80 may include an elongated body 96 with a first end 98 that is pivotally connected to a side rail 50, 52 of the frame 48, and a second end 100. The biasing member 94 may be located towards the second end 100 of the brace 80 and the biasing member may include an engagement surface 102 that is sized and configured to contact the pin 88. One end of the biasing member 94 may be attached to the elongated body 96 of the brace 80 and the other end may be disposed in a groove or channel 104 in the second end 100 of the brace 80. The biasing member 94 may be used to bias the pin 88 into the receiving portion 84 of the elongated slot 82, which may selectively lock the leg 32, 34, 36, 38 in the extended position. In particular, the biasing member 94 may exert a force to maintain the pin 88 in the receiving portion 86. To unlock the brace 80, a force sufficient to overcome the biasing member 94 may be applied to allow the pin 88 to move out of the receiving portion 86 of the elongated slot 82.

Advantageously, the brace 80 may automatically lock the legs 32, 34, 36, 38 in the extended position. Thus, for instance, as the pin 88 moves within the slot 82 towards the receiving portion 86, the pin may cause the biasing member 94 to move or rotate. Once the pin 88 is in the receiving portion 86, the biasing member 94 may move or rotate to bias the pin into the receiving portion. The pin 8 may be moved from the receiving portion 86 by moving the biasing member 94 and/or overcoming the biasing force. Significantly, the braces 80 can be made very strong because the brace itself does not have to deflect to disengage from the locked position. In contrast, the brace 80 may simply rotate into the desired position. Additionally, the brace 80 may be engaged in the locked position because the biasing member 94 may push, move or rotate the brace relative to the pin 88. It will be appreciated that this can also be accomplished by the biasing member 94 loading the brace 80 relative to the leg 32, 34, 36, 38 and/or the table top 12. If desired, the locking portion of the brace 80 could be a secondary part that rotates into position after the pin 88 slides past it.

The brace 80 and the biasing member 94 are preferably constructed from relatively strong and durable materials such as steel. It will be appreciated that the brace 80 and the biasing member 94 may also be constructed from other metals and materials with suitable characteristics, including materials such as plastics, composites and the like. Advantageously, because the biasing member 94 may help absorb forces applied to the brace 90, and the biasing member may help reduce the chances that the brace will be damaged by inadvertent impacts and/or through repeated use.

An exemplary use of the brace 80 is illustrated in FIGS. 13-15. For example, as seen in FIG. 13, the brace 80 is in a first position with the pin 88 in the receiving portion 86 and the biasing member 94 biasing the pin into the receiving portion. In this configuration, the leg 32, 34, 36, 38 may be locked in an extended position. As seen in FIG. 14, when the pin 88 is disposed at the end of the slot 82 and aligned with the receiving portion 86, the brace 80 may rotate to dispose the pin within the receiving portion. As seen in FIG. 15, the brace 80 may rotate as the pin 88 moves within the slot 82 as the leg 32, 34, 36, 38 is moved between the extended and collapsed positions. Advantageously, the brace 80 may securely maintain the leg 32, 34, 36, 38 in the locked position and the brace may be easily locked and unlocked by simply rotating the brace. One of ordinary skill in the art will appreciate after reviewing the disclosure herein that the brace 80 may have other suitable shapes, sizes, configurations and arrangements depending, for example, upon the type and/or intended use of the table 10.

Figure 16:
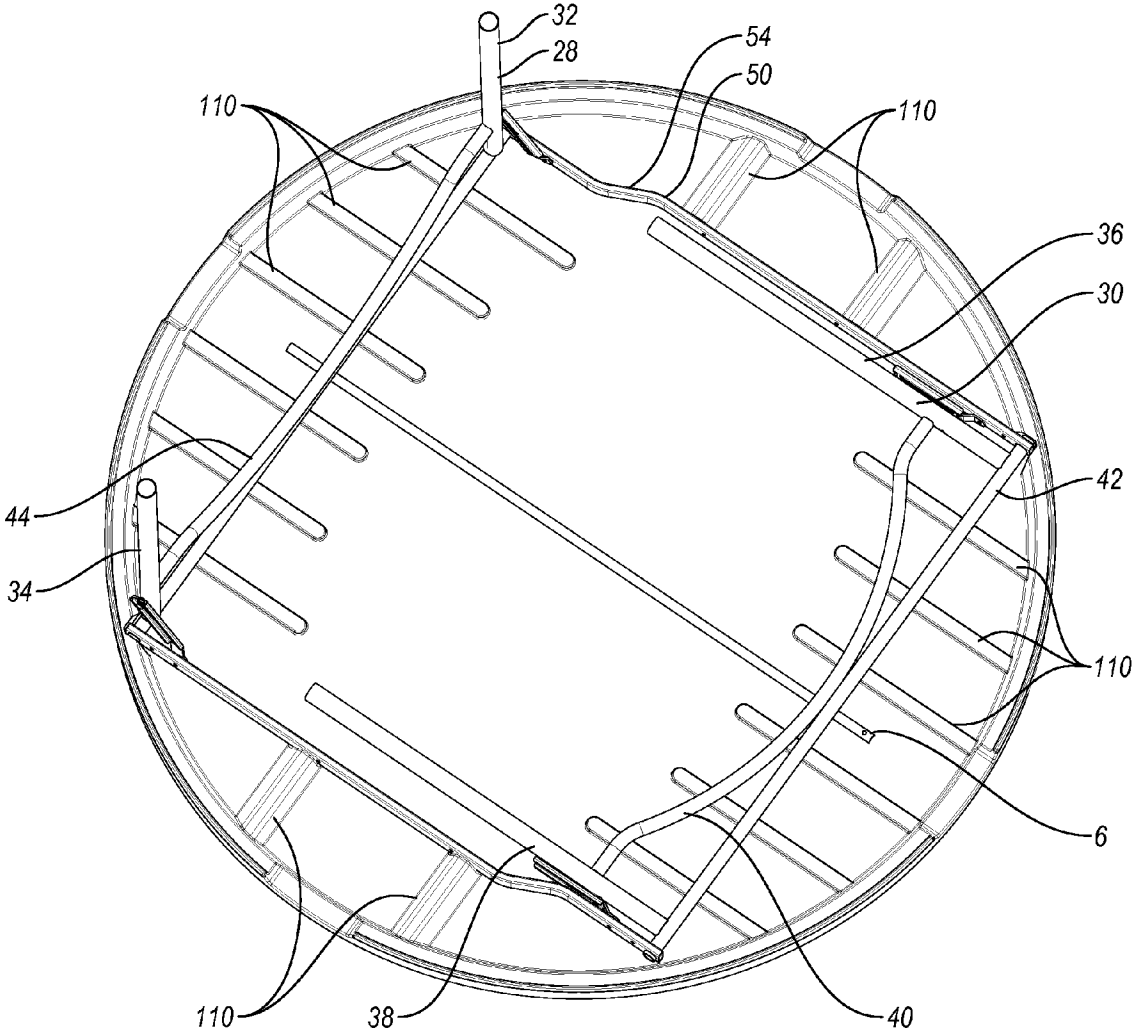
FIG. 16 is a bottom view of another embodiment of an exemplary table, illustrating a plurality of strengthening members.

As seen in FIG. 16, the table top 12 may include a plurality of strengthening members 110, which may be integrally formed with the table top as part of a unitary, one-piece construction. The strengthening members 110 may comprise outwardly extending portions, such as ribs or protrusions, that extend outwardly from the lower surface of the table top and/or inwardly extending portions, such as grooves or channels, which extend inwardly from the lower surface 16 of the table top 12. The strengthening members 110 may be sized and configured to strengthen and/or increase the rigidity of specific portions of the table top 12. In particular, the strengthening members 110 may be used to strength a portion of the table top that extends outwardly or beyond the frame 48 and/or the leg assemblies 28, 30.

As shown in the accompanying figures, the table top 12 may include a plurality of strengthening members 110 and the strengthening members may be disposed on opposing sides of the table top. The strengthening members 110 disposed on opposing sides may be aligned and have generally the same length. In addition, all of the strengthening members 110 may have generally the same length but it will be appreciated that the strengthening members 110 may have any suitable length.

The strengthening members 110 may be sized, shaped, configured and/or arranged to increase the strength, rigidity, structural integrity and/or torsion resistance of the table top 12. For example, the strengthening members 110 may have opposing walls 112, 114 and the opposing walls may increase the strength, rigidity, structural integrity and/or torsion resistance of the table top 12.

The strengthening members 110 disposed on both sides of a structural component such as the connecting members 40, 42 of the leg assemblies 28, 30. In particular, the strengthening members 110 may extend from the lip 20 to the other side of the connecting member 40, 42. Additionally, the ends of the strengthening members 110 may be disposed proximate a portion of the table top 12 that is not directly supported by the frame 48. For example, the ends of the strengthening members 110 may be disposed proximate the outer edge 18 of the table top 12. In particular, a first end of the strengthening members 110 may be disposed proximate the outer edge 18 of the table top 12, and the strengthening members 110 may be generally spaced apart an equal distance. Advantageously, the strengthening members 110 may increase the strength, stiffness, rigidity and/or structural integrity proximate the structural support members and the outer edge 18 of the table top 12. This may prevent, for example, the outer edge 18 of the table top 12 from rotating or moving downwardly relative to the connecting members 40, 42.

The strengthening members 110 may also be disposed between the frame 48 and the outer edge 18 of the table top 12. For example, a plurality of strengthening members 110 may be aligned in generally parallel planes and disposed at a right angle relative to the side rails 50, 52 of the frame 48. The strengthening members 110 may be sized and configured to prevent the portion of the table top 12 extending outwardly from the frame 48 from bending if a hinge point is generally aligned with the edge of the frame.

A plurality of strengthening members 110 may be used and the strengthening members may be disposed in different portions of the table top 12 and/or have different configurations. For example, as seen in FIG. 16, a first set of strengthening members 110 may be generally aligned on opposing sides of a first portion of the table top 12 and a second set of strengthening members may be generally aligned on opposing sides of a second portion of the table top. Thus, the first and second sets of strengthening members may be disposed at an angle, such as 90°. In addition, the first and second sets of strengthening members 110 may have different shapes, sizes, configurations and arrangements. For example, the first set of strengthening members 110 may be disposed on both sides of the connecting members 40, 42 of the leg assemblies 28, 30. On the other hand, the second set of strengthening members 110 may be disposed between the side rails 50, 52 of the frame 48 and the outer edge 18 of the table top 12. Thus, the second set of strengthening members 110 may have a shorter length than the first set of strengthening members. The second set of strengthening members 110, however, may have larger width than the width of the first set of strengthening members. In addition, the second set of strengthening members 110 may include an engagement surface that engages the side rails 50, 52 and this may help prevent undesired movement of the frame 48. One of ordinary skill in the art will appreciate after reviewing the disclosure herein that the strengthening members 110 may have different shapes, sizes, configurations and arrangements depending, for example, upon the location of the strengthening member.

One of ordinary skill in the art may appreciate after reviewing this disclosure that the tables disclosed herein may have a number of different aspects, features, characteristics and configurations. The tables may also have other suitable aspects, features, characteristics and configurations such as disclosed in Assignee's U.S. Pat. No. 7,069,865, entitled HIGH-STRENGTH, LIGHTWEIGHT BLOW-MOLDED PLASTIC STRUCTURES, issued Jul. 4, 2006; U.S. patent application Ser. No. 11/372,515, entitled HIGH-STRENGTH, LIGHTWEIGHT BLOW-MOLDED PLASTIC STRUCTURES, filed Mar. 9, 2006; U.S. patent application Ser. No. 13/455,041, entitled TABLES WITH NESTING TABLE TOP, filed Apr. 24, 2012, now U.S. Pat. No. 8,397,652; U.S. patent application Ser. No. 13/455,055, entitled FRAME FOR A TABLE, filed Apr. 24, 2012, now U.S. Pat. No. 8,408,146; U.S. patent application Ser. No. 13/455,073, entitled TABLE WITH MOLDED PLASTIC TABLE TOP, filed Apr. 24, 2012, now U.S. Pat. No. 8,622,007; U.S. patent application Ser. No. 13/455,076 entitled TABLE WITH MOLDED PLASTIC TABLE TOP, filed Apr. 24, 2012, now U.S. Pat. No. 9,138,050; U.S. patent application Ser. No. 13/455,081, entitled TABLE TOP, filed Apr. 24, 2012, now abandoned; and U.S. patent application Ser. No. 13/455,066, entitled TABLE, filed Apr. 24, 2012, now U.S. Pat. No. 8,347,795. Each of these patents and applications are incorporated by reference in its entirety.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A table comprising:
- a table top;
- a frame connected to the table top;
- a table leg movable between an extended position and a collapsed position relative to the table top;
- an engaging member connected to the table leg; and
- a brace comprising:
  - a first end of the brace connected to the frame;
  - a slot in a body of the brace, the engaging member disposed within the slot and movable within the slot when the table leg is moved between the extended and collapsed positions;
  - a receiving portion in a second end of the brace; and
  - a biasing member sized and configured to bias the table leg into a locked position when the table leg is in the extended position, the biasing member extending along at least a portion a length of the body of the brace, the biasing member comprising:
    - a first portion of the biasing member connected to a first portion of the brace; and
    - a second portion of the biasing member disposed in the receiving portion, the second portion of the biasing member capable of moving within the receiving portion relative to a second portion of the body of the brace.

2. The table as in claim 1, further comprising an engagement surface of the biasing member, the engagement surface of the biasing member sized and configured to engage the engaging member, the biasing member sized and configured to maintain the engaging member in a fixed position within the slot when the table leg is in the extended position.

3. The table as in claim 1, further comprises a receiving portion of the slot that is disposed at an angle relative to a body of the slot, the biasing member sized and configured to bias the engaging member into the receiving portion when the table leg is in the extended position.

4. The table as in claim 3, wherein the biasing member is capable of biasing the engaging member into the receiving portion when the engaging member moves within the body of the slot towards the receiving portion of the slot.

5. The table as in claim 1, wherein the first portion of the biasing member is pivotally connected to the body of the brace and the second portion of the biasing member is movable within a channel in a second end of the brace.

6. The table as in claim 5, wherein the second portion of the biasing member is disposed in a first position within the channel when the table leg is disposed in the locked position; and wherein the second portion of the biasing member is capable of moving within the channel when the table leg is moved between the extended and collapsed positions.

7. The table as in claim 1, further comprising a channel disposed in the brace, the first portion of the biasing member pivotally connected to the body of the brace and the second portion of the biasing member disposed in the channel.

8. The table as in claim 7, wherein the channel is disposed in a second end of the brace; and wherein the biasing member is movable between a first position and a second position within the channel.

9. The table as in claim 1, wherein the slot in the body of the brace is aligned along a first axis and the biasing member is aligned along a second axis, the first axis and the second axis partially overlapping and disposed at an angle when the engaging member is disposed in a receiving portion of the slot.

10. The table as in claim 1, wherein the engaging member is disposed in a first position within the slot when the table leg is disposed in the collapsed position;

wherein the biasing member is disposed in a first position when the table leg is disposed in the collapsed position;

wherein the engaging member is disposed within a second position within a receiving portion of the slot when the table leg is disposed in the extended position; and wherein the biasing member is disposed in the first position when the table leg is disposed in the extended position.

11. The table as in claim 1, wherein the slot has a generally J-shaped configuration with a receiving portion that is sized and configured to receive the engaging member when the table leg is in the extended position.

12. The table as in claim 1, wherein the biasing member comprises a spring, a first portion of the spring rotatably connected to the body of the brace in a fixed position proximate the slot and a second portion of the spring disposed within a channel in an end of the brace, the second portion of the spring capable of moving within the channel as the table leg is moved between the extended and collapsed positions.

13. The table as in claim 1, wherein the table is a round table that is sized and configured to nest with an adjacent round table to reduce a height of a plurality of stacked tables in a nested configuration, each table of a plurality of stacked tables being substantially identical.

14. The table as in claim 13, further comprising:

a receiving portion at least partially formed in the upper surface of the table top, the receiving portion having a generally circular configuration;

a lip extending downwardly from the table top, the lip having a generally circular configuration;

a contact surface in a first lower portion of the lip, the contact surface sized and configured to contact an upper surface of a table top of an adjacent table when the table is nested with the adjacent table, the contact surface having a generally ring-shaped configuration; and an engaging portion in a second lower portion of the lip, the engaging portion sized and configured to be disposed in a receiving portion of a table top of the adjacent table when the table is nested with the adjacent table, the engaging portion having a generally ring-shaped configuration.

15. The table as in claim 14, further comprising a handle disposed in an outer wall of the lip, the handle sized and configured to facilitate separation of a table from an adjacent table when the tables are stacked in the nested configuration.

16. The table as in claim 1, wherein the table top has a generally circular configuration, the table top further comprising:

a receiving portion at least partially formed in the upper surface of the table top, the receiving portion having a generally circular configuration;

a downwardly extending lip having a generally circular configuration;

a contact surface in a first lower portion of the lip, the contact surface sized and configured to contact an upper surface of a table top of an adjacent table when the table is nested with the adjacent table, the contact surface having a generally ring-shaped configuration; and an engaging portion in a second lower portion of the lip, the engaging portion sized and configured to be disposed in a receiving portion of a table top of the adjacent table when the table is nested with the adjacent table, the engaging portion having a generally ring-shaped configuration.

17. The table as in claim 16, wherein a circumference of the lip is generally equal to a circumference of the engaging portion; and wherein a circumference of the contact surface is less than the circumference of the lip and the engaging portion.

18. A table as in claim 16, further comprising a handle disposed in an outer wall of the lip, the handle sized and configured to facilitate separation of a table from an adjacent table when the tables are stacked in the nested configuration.

19. The round table as in claim 16, wherein the engaging portion is disposed about an outer periphery of the lower portion of the lip; and wherein the contact surface is disposed about an inner periphery of the lower portion of the lip.

20. An apparatus for connecting a table leg to a table, the table leg movable relative to the table between an extended position and a collapsed position, the apparatus comprising:

a frame sized and configured to be connected to a table top;

a table leg rotatably relative to the frame between an extended position and a collapsed position;

an engaging member connected to the table leg; and a brace comprising:

a body;

a first end of the body of the brace connected to the frame;

a slot extending along a length of the body of the brace along an axis, the engaging portion disposed within the slot and movable within the slot when the table leg is moved between the extended and collapsed positions;

a receiving portion disposed in a second end of the elongated body of the brace; and a biasing member comprising:

a first portion connected to the body of the brace;

a second portion disposed in the receiving portion and movable relative to a second end of the body of the brace between a first position in which the biasing member is capable of biasing the table leg into a locked position and a second position in which the biasing member does not bias the table leg into the locked position; and a central portion disposed at an angle relative to the slot extending along the length of the body of the brace when the biasing member biases the table leg into the locked position.

* * * * *